US007788776B2

(12) United States Patent
Sugahara

(10) Patent No.: US 7,788,776 B2
(45) Date of Patent: Sep. 7, 2010

(54) METHOD OF PRODUCING PIEZOELECTRIC ACTUATOR

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 917 days.

(21) Appl. No.: 11/277,612

(22) Filed: Mar. 27, 2006

(65) Prior Publication Data

US 2006/0213051 A1 Sep. 28, 2006

(30) Foreign Application Priority Data

Mar. 28, 2005 (JP) ..... 2005-092582

(51) Int. Cl.
*H04R 17/00* (2006.01)
*B05D 1/02* (2006.01)

(52) U.S. Cl. ..... 29/25.35; 29/890.1; 427/100; 427/282; 310/324

(58) Field of Classification Search ..... 29/25.35, 29/890.1, 831, 842; 310/324; 205/125; 347/68, 347/70, 71; 427/100, 282
See application file for complete search history.

(56) References Cited

U.S. PATENT DOCUMENTS 5,262,042 A * 11/1993 Okabayashi ..... 205/125 X
6,767,086 B2 * 7/2004 Murai ..... 347/70
2004/0256953 A1 * 12/2004 Kitagawa et al. ..... 310/324

FOREIGN PATENT DOCUMENTS

JP H2 187352 7/1990
JP H8 142324 4/1996
JP 10286960 A * 10/1998

* cited by examiner

*Primary Examiner*—A. Dexter Tugbang
(74) *Attorney, Agent, or Firm*—Baker Botts L.L.P.

(57) ABSTRACT

Grooves are formed in a supporting plate around element-arrangement areas in which a plurality of piezoelectric elements are to be arranged respectively. After forming the grooves, the piezoelectric elements are formed in the element-arrangement areas respectively by making particles of a piezoelectric material to be deposited on the element-arrangement areas in an amount which is more than an amount of the particles of the piezoelectric material made to be deposited on areas formed with the grooves. Accordingly, there is provided a method of producing a piezoelectric actuator and a piezoelectric actuator which make it possible to easily form the piezoelectric elements arranged densely.

6 Claims, 19 Drawing Sheets

METHOD OF PRODUCING PIEZOELECTRIC ACTUATOR

BACKGROUND OF THE INVENTION

1. Field of the Invention

The present invention relates to a method of producing the piezoelectric actuator for a liquid transporting apparatus, and a piezoelectric actuator.

2. Description of the Related Art

An ink-jet head including a piezoelectric actuator which applies a discharge pressure to ink by utilizing a deformation of a piezoelectric material when an electric field is acted on the piezoelectric material, is an example of an ink-jet head which discharges ink onto a recording paper. For example, an ink-jet head described in Japanese Patent Application Laid-open No. 8-142324 includes a liquid chamber unit having a plurality of pressure chambers (pressurized liquid chambers) communicating with a plurality of nozzles respectively, and a piezoelectric actuator (piezoelectric actuator unit) provided so as to face the plurality of pressurized liquid chambers. Here, the piezoelectric actuator has a plurality of piezoelectric elements each of which is arranged in an area of a vibration plate facing one of the pressure chambers. Each of the piezoelectric elements is constructed of a plurality of stacked piezoelectric layers made of lead zirconate titanate (PZT) or the like, and internal electrodes are interposed between these piezoelectric layers. When a drive voltage is applied to these internal electrodes, each of the piezoelectric layers sandwiched between the internal electrodes is deformed, and the vibration plate is deformed with the deformation of the piezoelectric layers, thereby changing a volume in the pressure chamber. Due to the change in the volume of the pressure chamber, pressure is applied to ink in the pressure chamber.

This piezoelectric actuator is produced by the following method. First of all, a piezoelectric element plate is formed by stacking alternately a plurality of piezoelectric layers and a plurality of internal electrodes. Afterward, this piezoelectric element plate is adhered to a substrate on which a wiring pattern is formed. The piezoelectric element plate is divided at a predetermined pitch by a dicer equipped with a diamond grinding wheel, and a plurality of piezoelectric elements corresponding to the plurality of pressure chambers respectively is formed.

SUMMARY OF THE INVENTION

In recent years, to realize both an improvement in a printing quality and a reduction in a size of ink-jet head, attempts have been made to arrange a plurality of nozzles with higher density. To arrange the nozzles with high density, it is necessary to arrange also the piezoelectric elements corresponding to these nozzles respectively, with high density. However, in a conventional method of dividing the piezoelectric element plate with a dicer, which is described in Japanese Patent Application Laid-open No. 8-142324, there are technical limitations on forming the piezoelectric element plate by dividing further minutely. Therefore, it is difficult to form the piezoelectric elements arranged with high density. Furthermore, in the conventional method of dividing the piezoelectric element plate by the dicer or the like, the piezoelectric element plate cannot be divided in a zigzag shape. Therefore, for arranging the nozzles with high density, the corresponding piezoelectric elements could not be arranged in a staggered (zigzag) lattice form.

An object of the present invention is to provide a method of producing a piezoelectric actuator which makes it possible to easily form a plurality of piezoelectric elements to be arranged with higher density, and to provide a piezoelectric actuator.

According to a first aspect of the present invention, there is provided a method of producing a piezoelectric actuator for a liquid transporting apparatus, the piezoelectric actuator being provided on one surface of a channel unit in which a liquid channel including a plurality of pressure chambers is formed, and including a vibration plate which covers the pressure chambers; a plurality of piezoelectric elements arranged, in the vibration plate on a side opposite to the pressure chambers, to correspond to the pressure chambers respectively; and a supporting section which supports these piezoelectric elements from a side opposite to the vibration plate, the method including:

a step of providing a supporting plate which forms the supporting section, and which has, on one surface thereof, element-arrangement areas in which the piezoelectric elements are to be arranged respectively;

a less-deposition area forming step of forming, on the supporting plate, less-deposition areas on which a piezoelectric material is less likely to be deposited than on the element-arrangement areas, around the element-arrangement areas respectively;

a piezoelectric element forming step of forming the piezoelectric elements by depositing particles of the piezoelectric material more on the element-arrangement areas of the supporting plate than on the less-deposition areas; and a joining step of joining the piezoelectric elements to the vibration plate.

According to the first aspect of the present invention, after forming the less-deposition areas on which the piezoelectric material is less likely to be deposited than on the element-arrangement areas, around the plane element-arrangement areas respectively, the particles of the piezoelectric element are deposited on the supporting plate which forms the supporting section. In the element-arrangement areas, particle of the piezoelectric element are made to be deposited in an amount which is more than an amount of the particles of the piezoelectric element deposited in the less-deposition areas. Therefore, in each of the element-arrangement areas, a piezoelectric element protruding towards the supporting plate on the side of the vibration plate is formed. In other words, it is possible to easily form, in the element-arrangement areas, a plurality of piezoelectric elements which protrude more toward the side of the vibration plate than the less-deposition areas. These piezoelectric elements are joined to the vibration plate. Moreover, as compared to a case of forming by dividing the piezoelectric elements by the dicer or the like, the piezoelectric elements arranged with high density can be formed at a low cost. Furthermore, since it was not possible to divide the piezoelectric elements in the zigzag form when the piezoelectric elements were formed by dividing by using the dicer or the like, the piezoelectric elements arranged in the staggered (zigzag) form could not be formed by this dividing method using dicer or the like. In the method of producing of the present invention, however, it is possible to form the piezoelectric elements divided and arranged at any position including an arrangement of a staggered (zigzag) lattice form.

In the method of producing the piezoelectric actuator of the present invention, in the less-deposition area forming step, grooves or holes may be formed in the supporting plate around the element-arrangement areas respectively. When the piezoelectric material is made to be deposited on the supporting plate having the grooves formed therein, the piezoelectric material is less likely to be deposited on the groove portions on the supporting plate around the element-arrangement areas, than in the element-arrangement areas which are in a plane form. Moreover, when the piezoelectric material is made to be deposited on the supporting plate with the holes formed therein, the piezoelectric material is not deposited on the hole portions at all. In any of the cases, on the element-arrangement areas, more piezoelectric material is deposited than on the less-deposition areas, each of which is an area having a groove or hole formed therein. Therefore, by a simple step of making the particles of the piezoelectric element to be deposited on the supporting plate, after forming the grooves or holes around the element-arrangement areas respectively, it is easy to form, in each of the element-arrangement areas on the supporting plate, the piezoelectric element which protrudes more prominently as compared with each of the less-deposition areas.

In the method of producing the piezoelectric actuator of the present invention, in the less-deposition area forming steps a mask layer which prevents deposition of the piezoelectric material may be formed on the supporting plate as the less-deposition areas; and in the piezoelectric element forming step, the mask layer may be removed after depositing the particles of the piezoelectric element on the supporting section. In this case, the piezoelectric material is not deposited on an area of the supporting plate on which the mask layer is formed. In other words, piezoelectric material is deposited more on the element-arrangement area than on the area formed with the mask layer. Therefore, it is easy to form the piezoelectric elements, which protrude more prominently as compared with the less-deposition areas, in the element-arrangement areas respectively on the supporting plate.

In the method of producing the piezoelectric actuator of the present invention, in the piezoelectric element forming step, the piezoelectric material may be deposited on the supporting plate by an aerosol deposition method, a sputtering method, or a chemical deposition method. In this case, piezoelectric elements having a desired thickness can be formed easily.

In the method of producing the piezoelectric actuator of the present invention, in the piezoelectric element forming step, each of the piezoelectric elements may be formed in the supporting plate by alternately repeating a step of forming one piezoelectric layer by depositing the particles of the piezoelectric material, and a step of forming a first electrode which is to be applied with predetermined voltage or a step of forming a second electrode which is to be maintained at common reference potential, such that each of the piezoelectric elements includes a plurality of stacked piezoelectric layers, and a plurality of first electrodes and a plurality of second electrodes alternately arranged between the stacked piezoelectric layers. The piezoelectric elements each having the plurality of stacked piezoelectric layers are capable of applying a desired pressure on a liquid in the pressure chambers by electric voltage that is lower than electric voltage applied to piezoelectric elements each having one piezoelectric layer. According to the present invention, it is possible to easily form the plurality of piezoelectric elements of stacked layer type.

In the method of producing the piezoelectric actuator of the present invention, the piezoelectric element forming step may include a step of forming one piezoelectric layer by depositing the particles of the piezoelectric material on the supporting plate, and a step of forming a first electrode to which a predetermined drive voltage is to be applied; and the piezoelectric elements each including the one piezoelectric layer and the first electrode may be formed on the supporting plate. According to the present invention, it is possible to easily form a single-layered piezoelectric element.

In the method of producing the piezoelectric actuator of the present invention, in the piezoelectric element forming step, the piezoelectric elements each of which protrudes more prominently than one of the less-deposition areas may be formed in the piezoelectric element-arrangement areas respectively. In this case, the particles of the piezoelectric material are deposited on the piezoelectric element-arrangement areas more thickly than on the less-deposition areas. Accordingly, when the formed piezoelectric elements are joined to the vibration plate, the piezoelectric material deposited on the less-deposition areas does not come in contact with the vibration plate.

According to a second aspect of the present invention, there is provided a piezoelectric actuator for a liquid transporting apparatus, which is provided on one surface of a channel unit in which a liquid channel including a plurality of pressure chambers is formed, the piezoelectric actuator including:

a vibration plate which covers the pressure chambers;

a plurality of piezoelectric elements arranged, in the vibration plate on a side opposite to the pressure chambers, to correspond to the pressure chambers respectively; and a supporting section which supports the piezoelectric elements from a side of the piezoelectric elements, the side being opposite to the vibration plate;

wherein grooves or holes are formed on the supporting section around the element-arrangement areas which are plane-shaped and in which the piezoelectric elements are arranged respectively.

According to the second aspect of the present invention, owing to the grooves or holes each of which is formed around one of the plane element-arrangement areas of the supporting section, the piezoelectric material is not deposited much in these portions around the element-arrangement areas, as compared with in the element-arrangement areas. Since the piezoelectric elements are separated or distanced from each other by these less-deposition areas, it is possible to reduce a phenomenon of cross-talk in which, when a certain piezoelectric element is driven, a deformation of that piezoelectric element affects an adjacent piezoelectric element.

In the piezoelectric actuator of the present invention, each of the piezoelectric elements may include one piezoelectric layer, a first electrode to which a predetermined drive voltage is applied, and a second electrode which is kept at a common reference electric potential. Further, the supporting section or the vibration plate may be formed of an electroconductive material, and the supporting section or the vibration plate formed of the electroconductive material may serve also as the second electrode. The piezoelectric actuator includes the piezoelectric elements each having a single piezoelectric layer. The piezoelectric elements having the single piezoelectric layer do not have a complicated structure, and have a high reliability of electric connections with electrodes of the piezoelectric element. Moreover, when the supporting section or the vibration plate is formed of an electroconductive material such as a metallic material, by making the supporting section or the vibration plate formed of the electroconductive material to serve also as the second electrode, the structure of the piezoelectric element can be simplified further and the reliability of the electrical connections for the piezoelectric element is improved.

In the piezoelectric actuator of the present invention, each of the piezoelectric elements may include a plurality of stacked piezoelectric layers, a plurality of second electrodes which are kept at a common reference electric potential, and a plurality of first electrodes to which a predetermined drive voltage is applied, the first and second electrodes being arranged between the stacked piezoelectric layers. Since a piezoelectric actuator including the piezoelectric elements each having the stacked piezoelectric layers can cause a substantial deformation with a low voltage, the piezoelectric actuator can be operated at a low electric power.

BRIEF DESCRIPTION OF THE DRAWINGS

FIG. 19 (FIGS. 19A and 19B) is a diagram showing a supporting plate of a third modified embodiment, in which

FIG. 21 (FIGS. 21A to 21E) is a diagram showing a producing process of a piezoelectric actuator according to a fourth modified embodiment, in which

FIG. 23 (FIGS. 23A and 23B) is a diagram showing a producing process of a piezoelectric actuator according to the fifth modified embodiment, in which

DETAILED DESCRIPTION OF THE PREFERRED EMBODIMENTS

Figure 1:
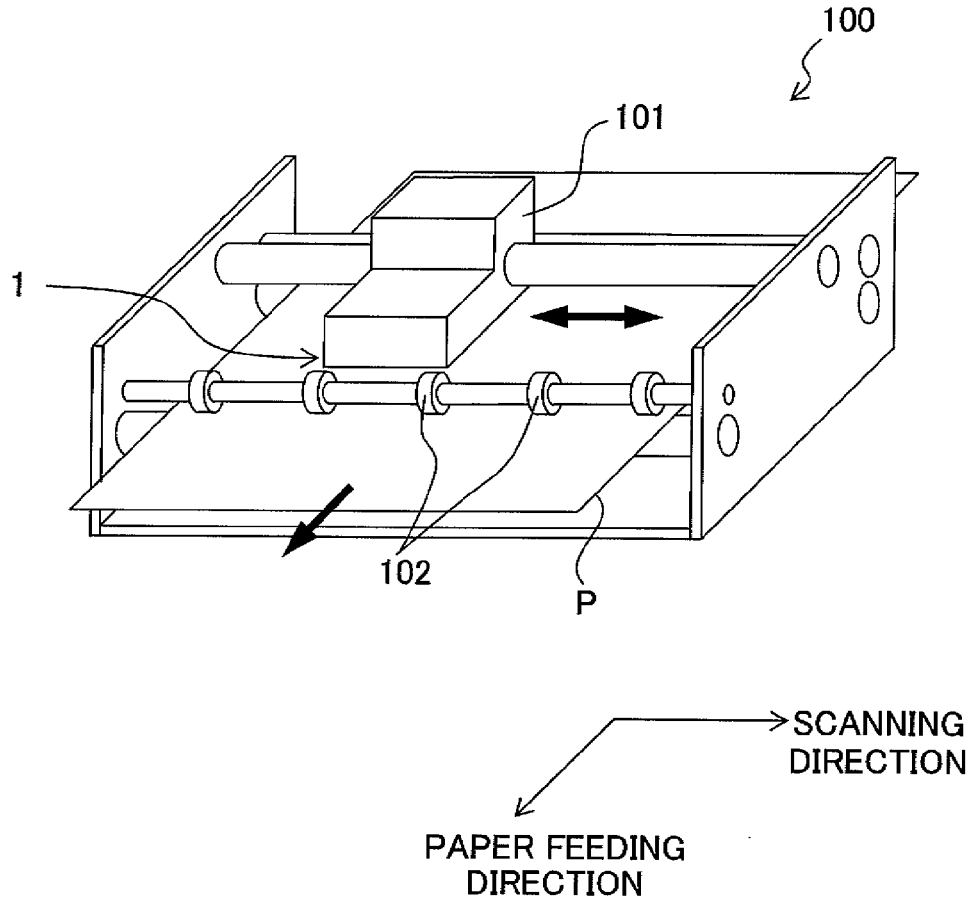
FIG. 1 is a schematic structural diagram of an ink-jet printer according to an embodiment of the present invention.

An embodiment of the present invention will be explained below. The embodiment is an example in which the present invention is applied to an ink-jet head, which discharges ink onto a recording paper from nozzles, as a liquid transporting apparatus. Firstly, an ink-jet printer 100 which includes an ink-jet head 1 will be explained briefly. As shown in FIG. 1, the ink-jet printer 100 includes a carriage 101 which is movable in a scanning direction in FIG. 1, the ink-jet head 1 of serial type which is provided on the carriage 101 and which discharges ink onto a recording paper P, and transporting rollers 102 which teed the recording paper P in a paper feeding direction in FIG. 1. The ink-jet head 1 moves integrally with the carriage 101 in the scanning direction, and discharges ink onto the recording paper P from ejecting ports of nozzles 20 (see FIGS. 2 to 6) formed in an ink discharge surface of a lower surface of the ink jet head 1. The recording paper P with an image and/or a letter recorded thereon by the ink-jet head 1 is discharged forward (paper feeding direction) by the transporting rollers 102.

Next, the ink-jet head 1 will be explained in detail with reference to FIGS. 2 to 6. As shown in FIGS. 2 to 6, the ink-jet head 1 includes a channel unit 2 in which ink channels are formed, and a piezoelectric actuator 3 which is arranged on an upper side of the channel unit 2.

Figure 4:
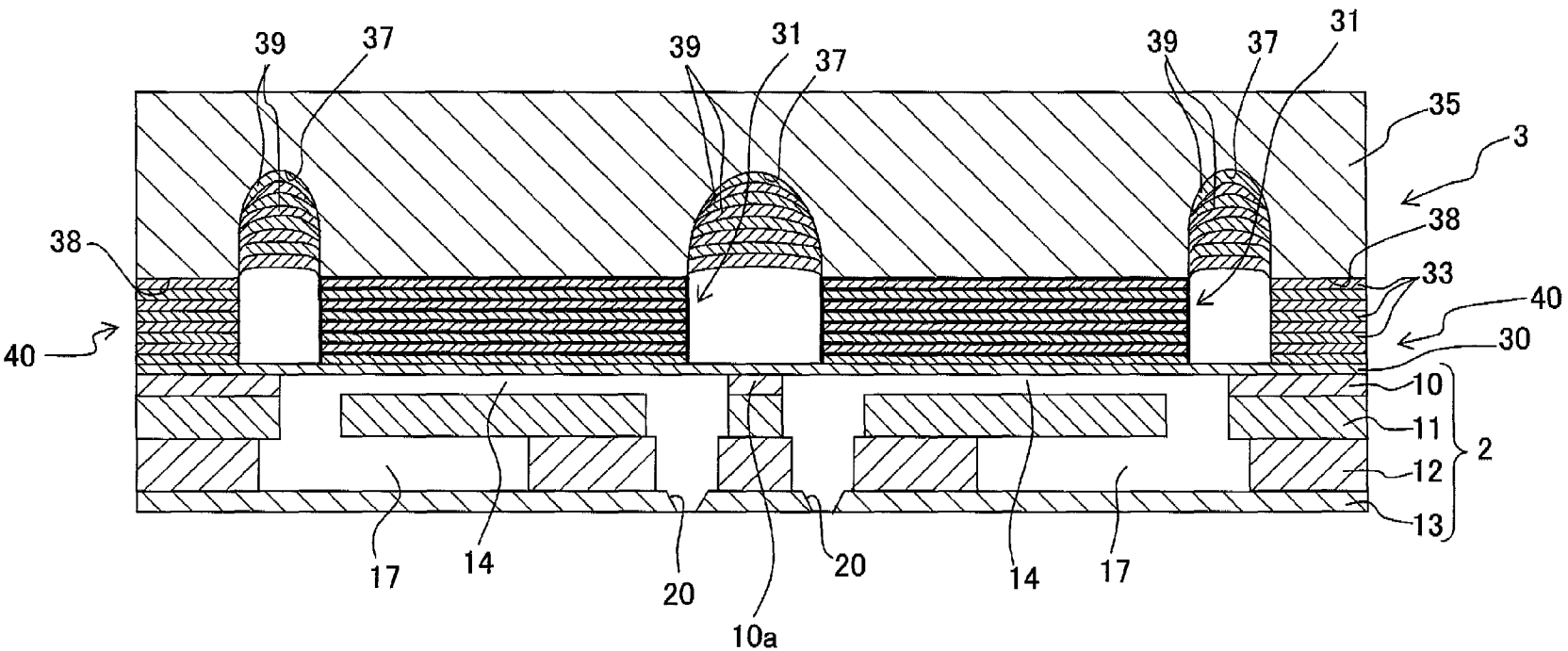
FIG. 4 is a cross-sectional view taken along a line IV-IV in FIG. 3.
Figure 5:
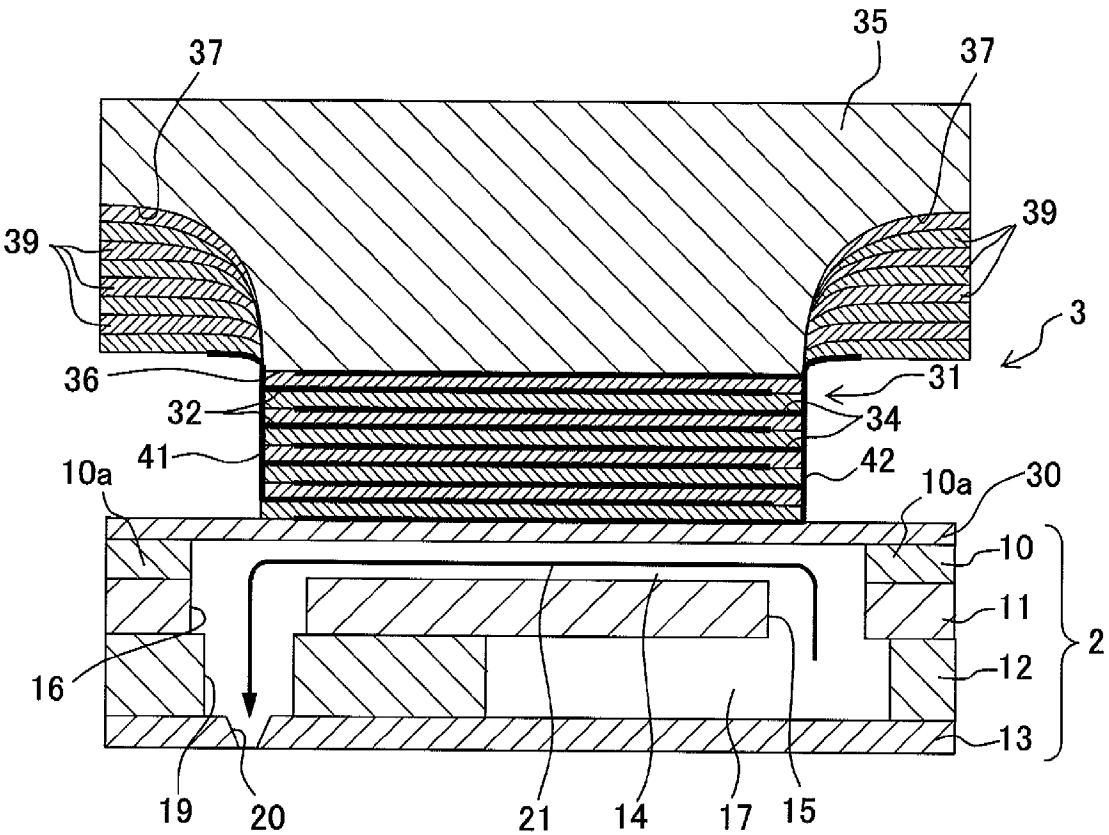
FIG. 5 is a cross-sectional view taken along a line V-V in FIG. 3.
Figure 6:
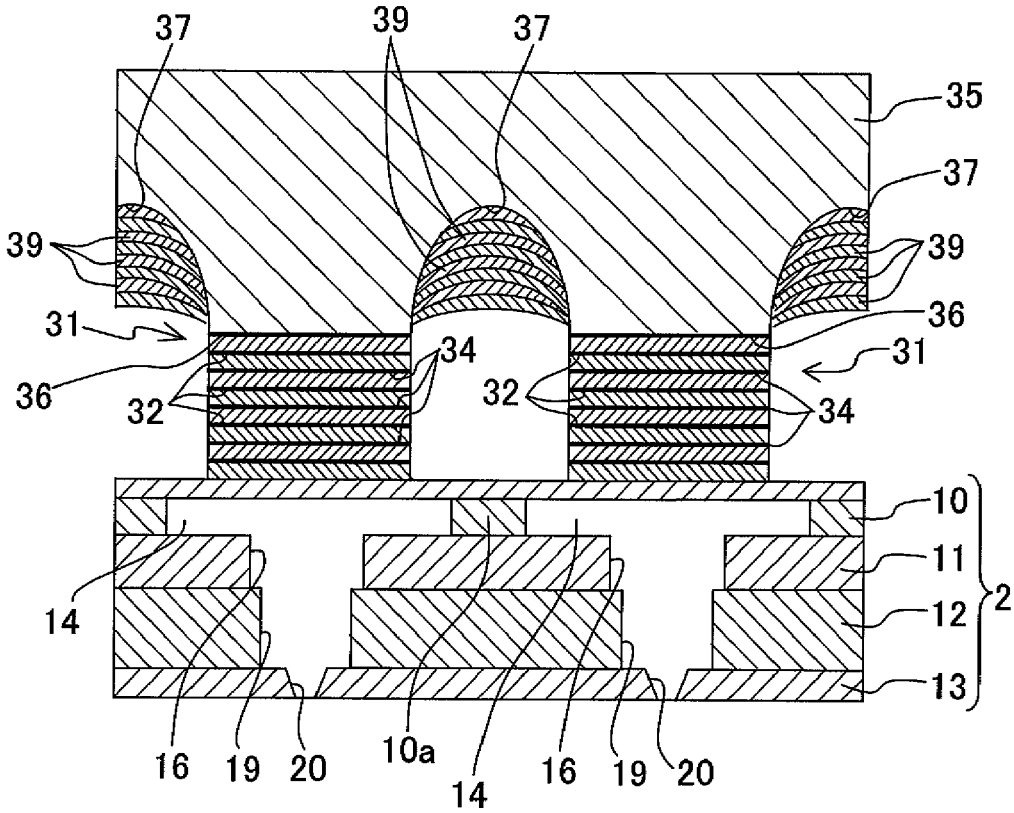
FIG. 6 is a cross-sectional view taken along a line VI-VI in FIG. 3.

Firstly, the channel unit 2 will be explained below. As shown in FIGS. 4 to 6, the channel unit 2 includes a cavity plate 10, a base plate 11, a manifold plate 12, and a nozzle plate 13, and these four plates are joined in stacked layers. Among these four plates, the cavity plate 10, the base plate 11, and the manifold plate 12 are stainless steel plates. Ink channels such as a pressure chamber 14 and a manifold 17 which will be described later, can be formed easily in these plates by etching. The nozzle plate 13 is formed of a high-molecular synthetic resin material such as polyimide, and is joined to a lower surface of the manifold plate 12. Alternatively, the nozzle plate 13 may also be formed of a metallic material such as stainless steel, similar to the three plates 10 to 12.

As shown in FIGS. 2 to 6, in the cavity plate 10, partition walls 10*a* are defined due to the formation of a plurality of pressure chambers 14 arranged along a plane. In other words, the pressure chambers 14 are separated from each other by the partition walls 10*a*. Further, the pressure chambers 14 are open upwardly, and the pressure chambers 14 are arranged in two rows in the paper feeding direction (up and down direction in FIG. 2). Each of the pressure chambers 14 is substantially elliptical in a plan view and is arranged such that the pressure chamber 14 is long in the scanning direction (left and right direction in FIG. 2).

Communicating holes 15 and 16 are formed in the base plate 11 at positions which overlap in a plan view with both end portions respectively in the longitudinal direction of each of the associated pressure chambers 14. Further, in the manifold plate 12, a manifold 17 is formed. The manifold 17 is extended in the paper feeding direction (up and down direction in FIG. 2) and overlaps in a plan view with an end portion of each of the pressure chambers 14 on a side of the communicating hole 15. Ink is supplied to the manifold 17 from the ink tank (omitted in the diagram) via an ink-supply port 18 formed in a vibration plate 30 which will be described later. Moreover, a communicating hole 19 is formed at a position which overlaps in a plan view with an end portion of each of the pressure chambers 14, the end portion being on a side of the pressure chamber opposite to the manifold 17. Furthermore, a plurality of nozzles 20 is formed in the nozzle plate 13 at positions each of which overlaps in a plan view with one of the communicating holes 19. The nozzles 20 are formed, for example, by subjecting a substrate made of a high-molecular synthetic resin such as polyimide to an eximer laser processing.

As shown in FIG. 5, the manifold 17 communicates with each of the pressure chambers 14 via one of the communicating holes 15, and each of the pressure chambers 14 communicates with one of the nozzles 20 via the communicating holes 16 and 19. Thus, a plurality of ink channels 21 each from the manifold 17 up to one of the nozzles 20 via one of the pressure chambers 14 is formed in the channel unit 2.

Next, the piezoelectric actuator 3 will be explained below. As shown in FIGS. 2 to 6, the piezoelectric actuator 3 includes the vibration plate 30, piezoelectric elements 31, and a supporting plate 35. The vibration plate 30 covers the plurality of pressure chambers 14. The piezoelectric elements 31 are arranged on the upper surface (surface on a side opposite to pressure chambers) of the vibration plate 31, corresponding to the pressure chambers 14 respectively. The supporting plate 35 (supporting section) supports these piezoelectric elements 31 from an upper side (side opposite to the vibration plate).

The vibration plate 30 is a plate having substantially rectangular shape in a plan view and is made of a metallic material such as an iron alloy like stainless steel, a copper alloy, a nickel alloy, or a titanium alloy, a silicon or glass material, a ceramics material like alumina and zirconia, or a synthetic resin material like polyimide. The vibration plate 30 is joined to the upper surface of the cavity plate 10 so as to cover the pressure chambers 14.

Figure 2:
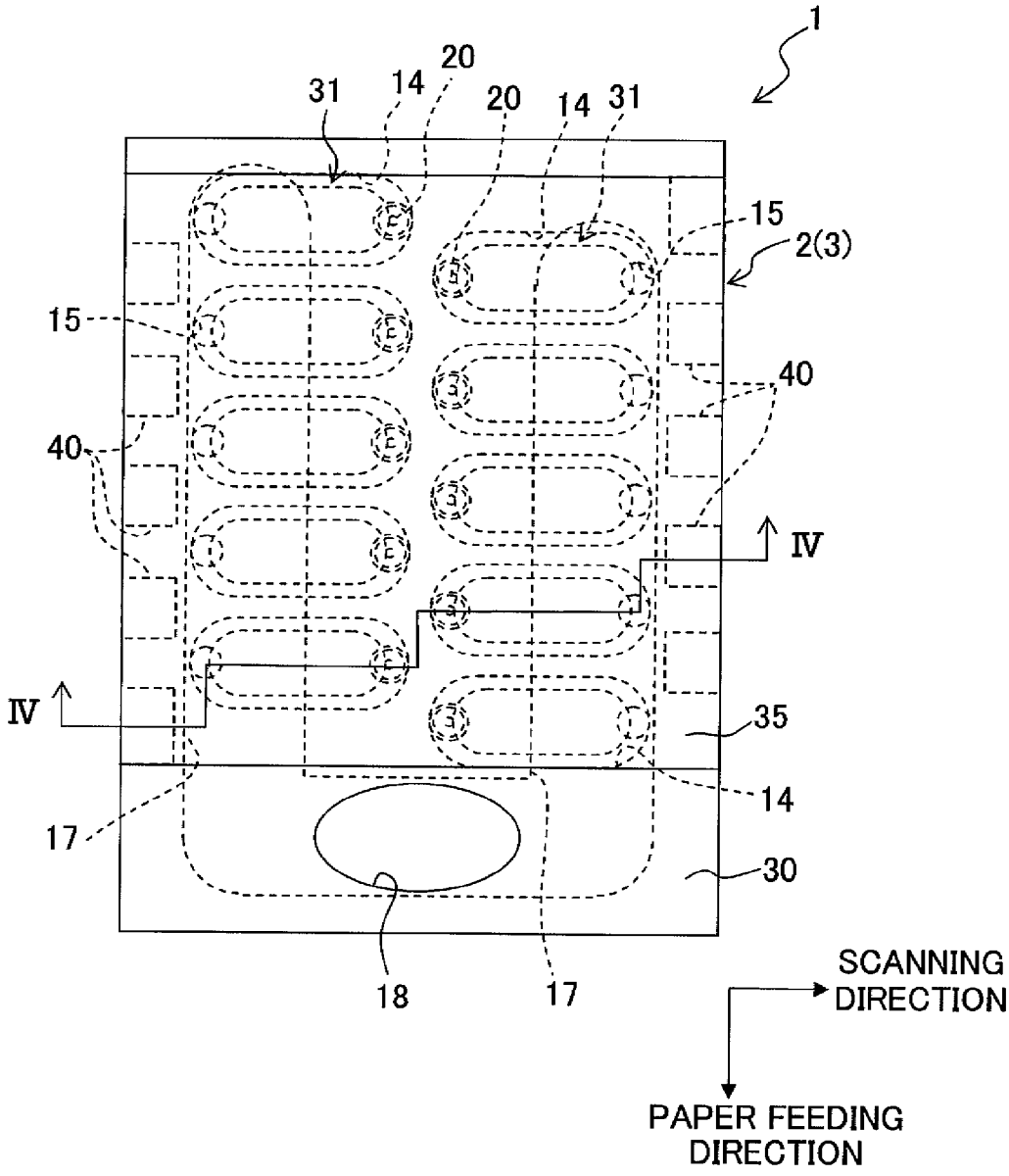
FIG. 2 is a plan view of an ink-jet head.
Figure 3:
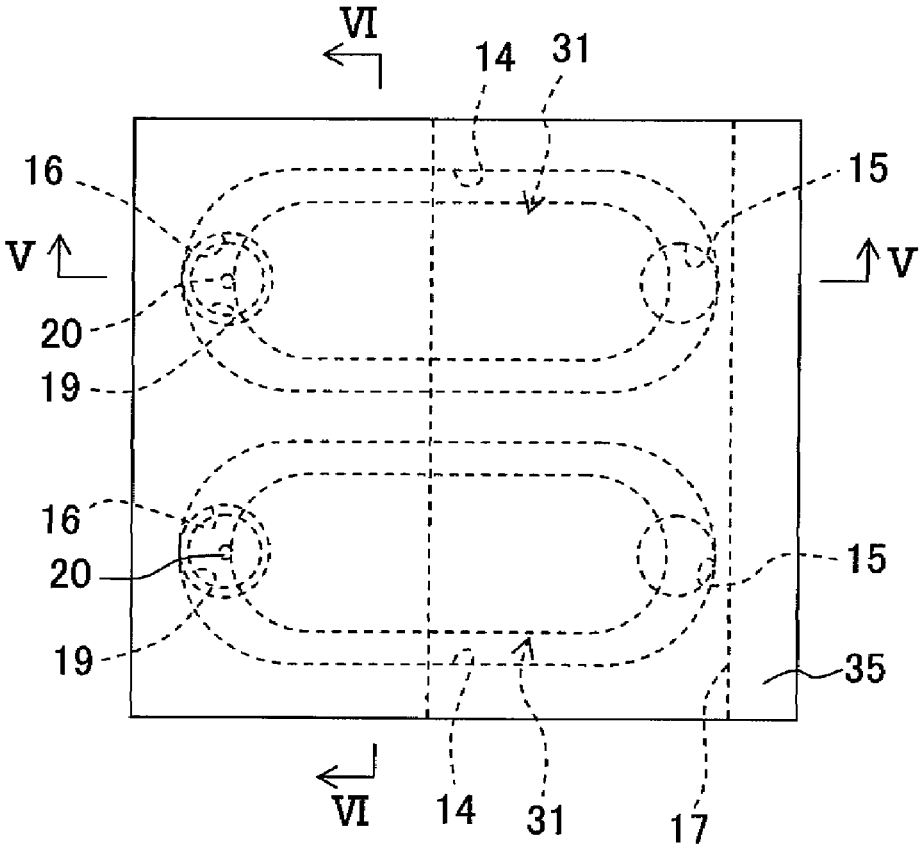
FIG. 3 is a partially enlarged view of FIG. 2.

Each of the piezoelectric elements 31 has a substantially elliptical plane shape which is smaller to some extent in size than one of the pressure chambers 14, and is arranged on the upper surface of the vibration plate 30 at an area overlapping in a plan view with a central portion of a pressure chamber 14 corresponding thereto and included in the pressure chambers 14. As shown in FIG. 2, the piezoelectric elements 31 are arranged in two rows in parallel with the paper feeding direction (up and down direction in FIG. 2), similarly as the pressure chambers 14. Each of the piezoelectric elements 31 includes a plurality of piezoelectric layers 33 stacked vertically in a thickness direction of the piezoelectric element, a plurality of individual electrodes 32 (first electrodes), and a plurality of common electrodes 34 (second electrodes). Each of the piezoelectric layer 33 is formed of a ferroelectric piezoelectric material such as lead zirconate titanate (PZT), and is polarized in a thickness direction of the piezoelectric layer. The individual electrodes 32 and the common electrodes 34 are arranged alternately between the respective piezoelectric layers 33, and arranged on the upper and lower surfaces of the outermost piezoelectric layers 33 respectively.

As shown in FIG. 5, the individual electrodes 32 of each of the piezoelectric elements 31 are drawn toward one side in a longitudinal direction (left side in FIG. 5) of the piezoelectric element 31, and the individual electrodes 32 are connected to a first side surface electrode 41 which is formed on left side surface portions of the piezoelectric layers 33 in FIG. 5. On the other hand, the common electrodes 34 of each of the piezoelectric elements 31 are drawn toward the other side in the longitudinal direction (right side in FIG. 5), and the common electrodes 34 are connected to a second side surface electrode 42 which is formed on right side surface portions of the piezoelectric layers 33 in FIG. 5. Although not particularly shown in the diagram, the first side surface electrode 41 and the second side surface electrode 42 are connected to a driver IC (omitted in the diagram) via a flexible wiring member (omitted in the diagram) such as a flexible printed circuit (FPC). A drive voltage is applied to the individual electrodes 32 from the driver IC via the first side surface electrode 41 and the wiring member. Further, the common electrodes 34 are kept at a ground potential (predetermined reference electric potential) via the second side surface electrode 42 and the driver IC.

Figure 7:
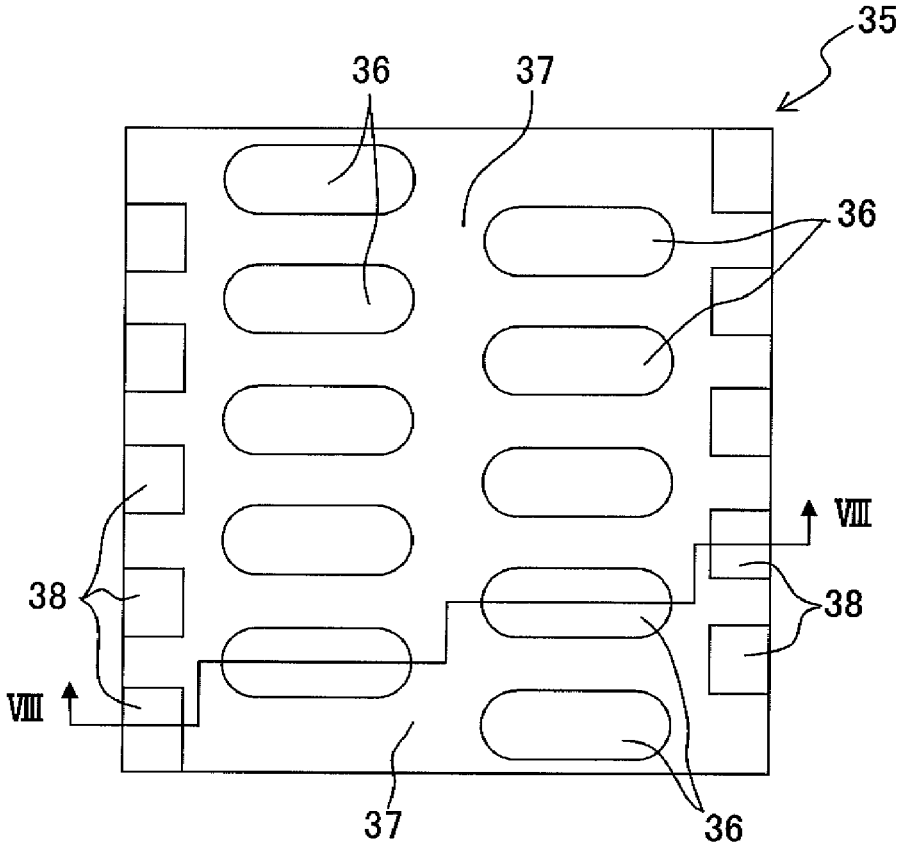
FIG. 7 is a bottom view of a supporting plate.
Figure 8:
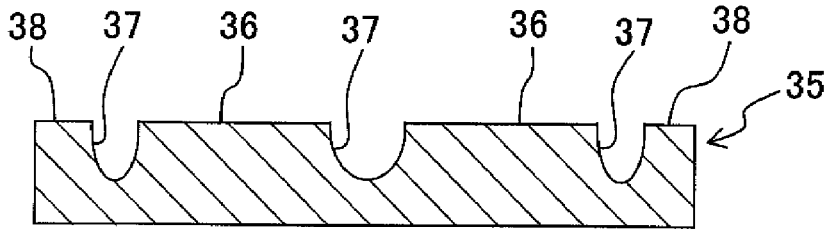
FIG. 8 is a cross-sectional view taken along a line VIII-VIII in FIG. 7.

The supporting plate 35 in the form of a flat plate is arranged on the upper surfaces of the piezoelectric elements 31. The supporting plate 35 is made of a metallic material such as stainless steel, or a ceramics material such as alumina and zirconia. FIG. 7 is a schematic plan view of the supporting plate 35 as viewed from a side of a bottom surface, and FIG. 8 is a cross-sectional view taken along a line VIII-VIII in FIG. 7. Therefore, an upper side in FIG. 8 corresponds to the side of the bottom surface of the supporting plate 35. As shown in FIGS. 7 and 8, grooves 37 are formed in the bottom surface of the supporting plate 35 around flat areas (element-arrangement areas 36) each of which is in contact with one of the piezoelectric elements 31. As shown in FIGS. 5, 6, and 8, each of the grooves 37 is formed such that an inner surface of a portion of the groove adjacent to one of the piezoelectric elements 31 is substantially a vertical surface, and that the inclination of the inner surface becomes gentler as approaching towards a front end side (upper surface side) of the groove 37, and a front end portion (end portion on a side of the upper surface) of the groove 37 is substantially flat. Moreover, as shown in FIGS. 5 and 6, piezoelectric material layers 39 formed of a piezoelectric material such as PZT similarly as the piezoelectric layer 33, are formed in a form of stacked layers in the inside of each of the grooves 37.

As shown in FIGS. 2, 4, and 7, supporting columns 40 are arranged at areas on a surface (upper surface) of the vibration plate 30 opposite to the pressure chambers 14, the areas facing a plurality of areas 38 located in both end portions in the scanning direction of the support plate 35. The areas 38 of the supporting plate 35 are arranged at a suitable interval in the paper feeding direction (up and down direction in FIG. 7). Each of the supporting columns 40, similar to the piezoelectric element 31, includes a plurality of piezoelectric layers 33 made of a piezoelectric material such as PZT and in the stacked form. However, unlike the piezoelectric elements 31, no electrodes are provided to the supporting columns 40. The height of the supporting columns 40 is substantially same as the height of the piezoelectric elements 31. The supporting columns 40 perform a role of accepting or receiving a reaction force generated when the vibration plate 30 is pushed towards the pressure chambers 14 upon deformation of the piezoelectric elements 31 at a time of an ink discharge operation. The piezoelectric elements 31 and the supporting columns 40 are joined or adhered to the upper surface of the vibration plate 30 by an epoxy adhesive, in a state that the piezoelectric elements 31 and the supporting columns 40 are connected with each other by the supporting plate 35.

Next, an action of the piezoelectric actuator 3 at the time of the ink discharge operation will be explained below. When a drive voltage is applied from the drive IC to the individual electrode 32 of a certain piezoelectric element 31 of the piezoelectric elements 31 via the first side surface electrode 41 and the wiring member, the electric potential of the individual electrode 32 differs from the electric potential of the common electrode 34 kept at the ground potential. At this time, an electric field, in a direction parallel to the thickness direction of the piezoelectric layer 33 that is a polarization direction of the piezoelectric layer 33, is generated in a portion of the piezoelectric layer 33 sandwiched between the individual electrode 32 and the common electrode 34, and due to a piezoelectric longitudinal effect, the portion of the piezoelectric layer 33 sandwiched between the individual electrode 32 and the common electrode 34 is extended in the thickness direction. Due to the deformation of the piezoelectric layer 33, the vibration plate is pushed towards the pressure chamber 14 and a volume of the pressure chamber 14 is decreased. When the volume of the pressure chamber 14 is decreased, pressure is applied to ink in the pressure chamber 14, thereby ejecting droplets of ink from the nozzle 20 communicating with the pressure chamber 14.

Each of the piezoelectric element 31 has the plurality of piezoelectric layers 33, and when the piezoelectric element 31 is driven, each of the piezoelectric layers 33 is extended in the thickness direction. Therefore, a total amount of deformation of the piezoelectric element 31 becomes substantial and a substantial pressure can be applied to the ink in the pressure chamber 14 at a low drive voltage, as compared to a piezoelectric element which includes one piezoelectric layer. Moreover, the groove 37 is formed in the bottom surface of the supporting plate 35, around an area in which one of the piezoelectric elements 31 are arranged. Accordingly, the groove 37 makes each of the piezoelectric elements 31 deform easily.

Figure 9:
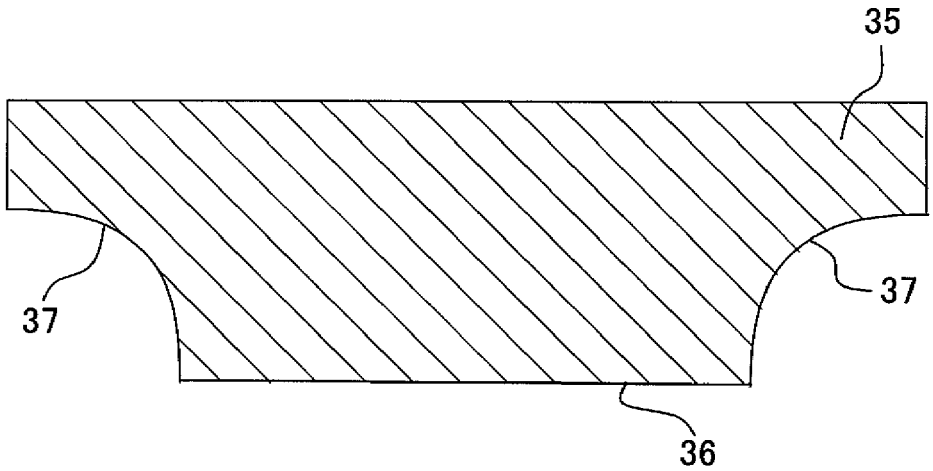
FIG. 9 is a diagram showing a step of forming a groove in the supporting plate.

Next, a method of producing the piezoelectric actuator 3 will be explained. Firstly, as shown in FIGS. 7 to 9, the grooves 37 are formed on one surface of the supporting plate 35, around the areas 38 in each of which the supporting columns 40 (see FIGS. 2 and 4) is arranged and around portions in each of which one of the element-arrangement areas 36 (see FIGS. 2 and 4) is arranged (less-deposition area forming step). Each of the element-arrangement areas 36 has a substantially elliptical shape in a plan view, and is a flat area in which one of the piezoelectric elements 31 is arranged. Here, when the supporting plate 35 is made of a metallic material such as stainless steel, the grooves 37 can be formed easily by etching. In this case, as shown in FIG. 9, each of the grooves 37 is formed to have a shape such that as a depth of a position at the inner surface is greater from the surface of the supporting plate 35, the inclination of the inner surface becomes gentler. Alternatively, the grooves 37 may be formed by a processing such as a microblast processing or an electric discharge processing. On the other hand, when the supporting plate 35 is made of a ceramics material such as alumina and zirconia, the groove 37 can be formed by the microblast processing.

Figure 10:
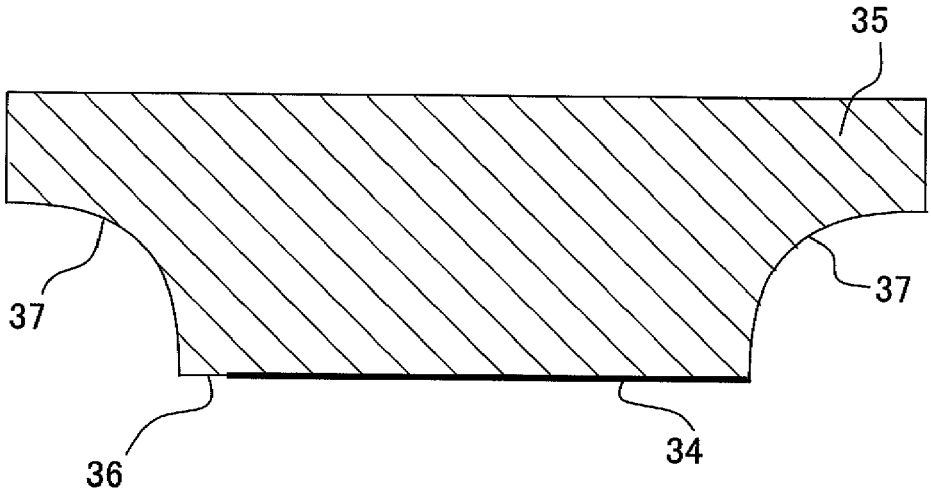
FIG. 10 is a diagram showing a step of forming a common electrode.

Next, the piezoelectric elements 31 are formed in the element-arrangement areas 36 of the supporting plate 35 (piezoelectric element forming step). Firstly, as shown in FIG. 10, a common electrode 34 extending, from an area in the vicinity of one end portion in a longitudinal direction (left end portion in FIG. 10) of each of the element-arrangement areas 36, up to other end portion (right end portion in FIG. 10) is formed (common electrode forming step). The common electrode 34 can be formed, for example, by a screen printing. Alternatively, the common electrodes 34 may be formed by forming an electroconductive film entirely on the surfaces of the element-arrangement areas 36 by a method such as a physical vapor deposition (PVD) or a chemical vapor deposition (CVD), and then partially removing the electroconductive film on the one end portion in the longitudinal direction of each of the element-arrangement areas 36 by a method such as laser processing.

Figure 11:
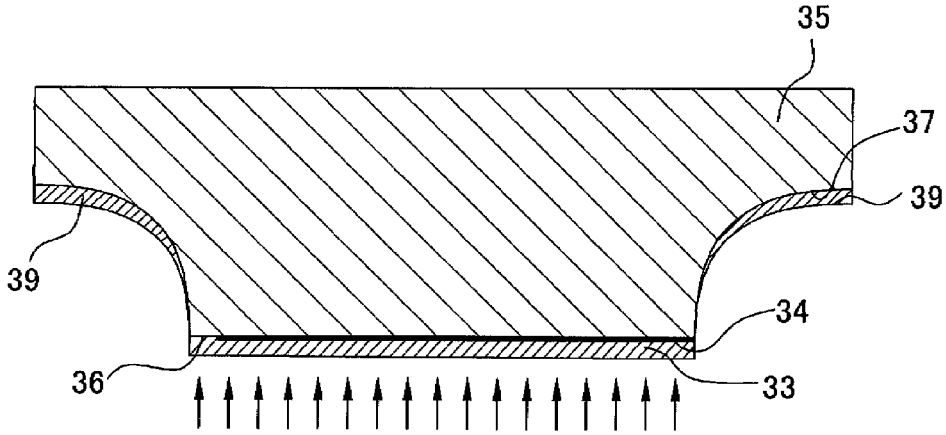
FIG. 11 is a diagram showing a step of forming a piezoelectric layer.

Next, as shown in FIG. 11, a piezoelectric layer 33 is formed on each of the element-arrangement areas 36 by blowing particles of a piezoelectric material such as PZT on an entire surface of the supporting plate 35 (piezoelectric layer forming step). Here, the particles of the piezoelectric material can be made to be deposited on the supporting plate 35 by the aerosol deposition method in which the fine particles with a carrier gas are made to collide on a substrate (supporting plate 35) at a high speed. Here, the grooves 37 have been formed around the element-arrangement areas 36. Further, the piezoelectric material is hardly deposited on the inner surface, having a substantial inclination, of each of the grooves 37 in the supporting plate 35, because a proportion of rebounding of the fine particles which do not contribute to film forming becomes great in the inner surface of each of the grooves 37. Only a small amount of the particles of the piezoelectric material is deposited on a flat portion of an inner end of each of the grooves 37, and in the grooves 37, the particles are less likely to be deposited as compared to the particles deposited on the element-arrangement areas 36 of the supporting plate 35. In other words, likelihood or susceptibility of deposition of the particles (degree of deposition) on the inner surface of each of the grooves 37 is lower than on each of the flat-shaped element-arrangement areas 36, and the piezoelectric material is deposited on the element-arrangement areas 36 in an amount greater than an amount of the piezoelectric material deposited on the grooves 37. The areas formed with the groove 37 respectively are the less-deposition areas of the present application. Therefore, one layer of the piezoelectric layer 33, which has a constant thickness and is thicker than a piezoelectric material layer 39 deposited in one of the grooves 37, is formed in each of the element-arrangement areas 36. Although not shown particularly in the diagram, when the piezoelectric layer 33 is formed in each of the element-arrangement areas 36, one layer of the piezoelectric layer 33 which forms a portion of each of the supporting columns 40 is formed simultaneously also in each of the areas 38 in which the columns 40 are to be arranged.

Further, other than using the aerosol deposition (AD) method, the particles of the piezoelectric material may be deposited by using the sputtering method or the chemical vapor deposition (CVD) method. In this case also, the degree of deposition of the piezoelectric material on the inner surface of the groove 37 becomes lower than the degree of deposition on the element-arrangement area 36 having a plane shape, and one piezoelectric layer 33, which has a constant thickness and is thicker than the piezoelectric material layer 39 deposited in the groove 37, is formed in the element-arrangement area 36. Although with the sputtering method and the CVD method, the piezoelectric material is deposited on the inclined inner surface of the groove 37 in an amount which is somewhat greater as compared to the aerosol deposition (AD) method, the fact remains that on the inner surface of the groove 37, the piezoelectric material is less likely to be deposited than on the element-arrangement area 36.

Figure 12:
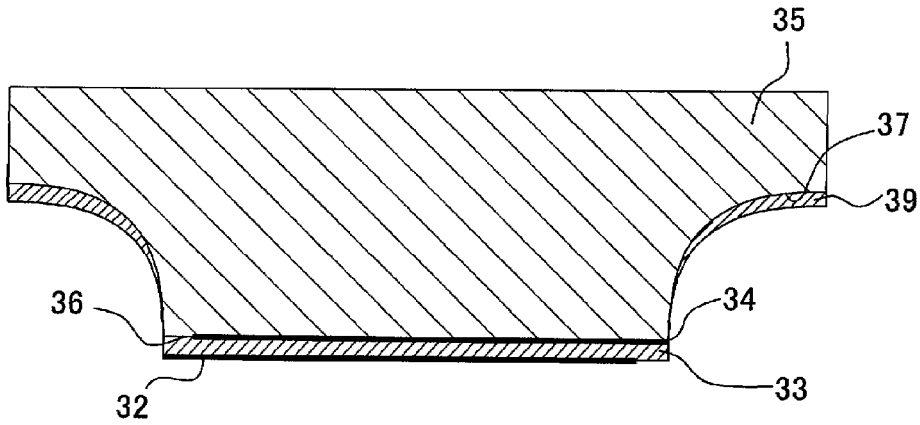
FIG. 12 is a diagram showing a step of forming a common electrode.

Next, as shown in FIG. 12, an individual electrode 32 extending from one end portion in the longitudinal direction (left end portion in FIG. 12) of each of the element-arrangement areas 36 up to an area in the vicinity of the other end portion (right end portion in FIG. 12) of the element-arrangement area 36 is formed (individual electrode forming step). The individual electrode 32 can also be formed by the screen printing, similar to the common electrode 34. Alternatively, the individual electrodes 32 may be formed by forming an electroconductive film on the entire surfaces of the element-arrangement areas 36 by a method such as the physical vapor deposition (PVD) or the chemical vapor deposition (CVD), and then partially removing the electroconductive film on one end portion in the longitudinal direction of the element-arrangement areas 36 by a method such as the laser processing.

Figure 13:
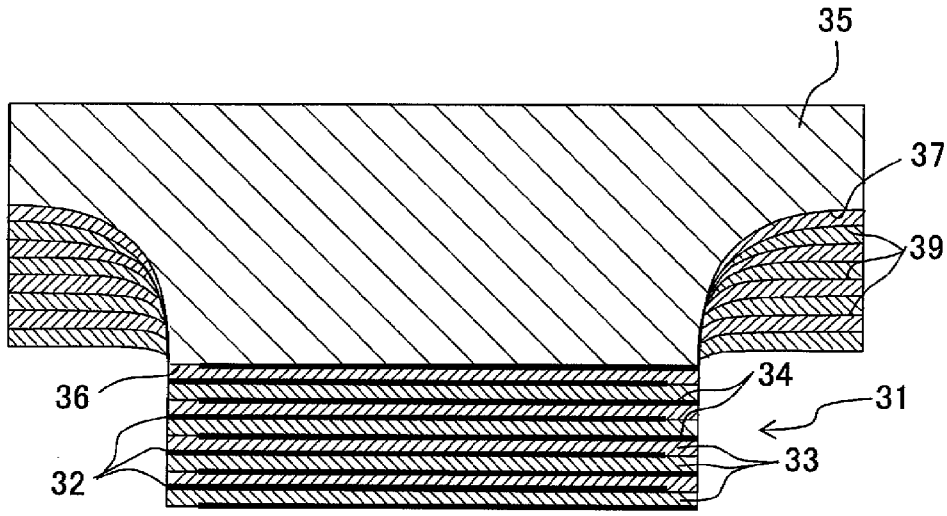
FIG. 13 is a diagram showing a state in which a plurality of piezoelectric layers are stacked.

By alternately repeating the common electrode forming step or the individual electrode forming step, and the piezoelectric layer forming step of forming one piece of the piezoelectric layer 33, a piezoelectric element 31 is formed in each of the element-arrangement areas 36 of the supporting plate 35 as shown in FIG. 13 (piezoelectric layer forming step). Each of the piezoelectric elements 31 includes a plurality of piezoelectric layers 33, and a plurality of individual electrodes 32 and a plurality of common electrodes 34 arranged alternately between the respective piezoelectric layer 33, and arranged on the upper and lower surfaces of the outermost layers respectively of the piezoelectric layers 33. Further, each of the piezoelectric elements 31 is formed to protrude more downwardly (toward a side opposite to the supporting plate 35) than an area in which one of the grooves 37 is formed. When the piezoelectric elements 31 are formed, the supporting columns 40 (see FIGS. 2 and 4) are also formed in the areas 38 respectively (see FIGS. 7 and 8) on both end portions of the supporting plate 35 in the scanning direction.

Figure 14:
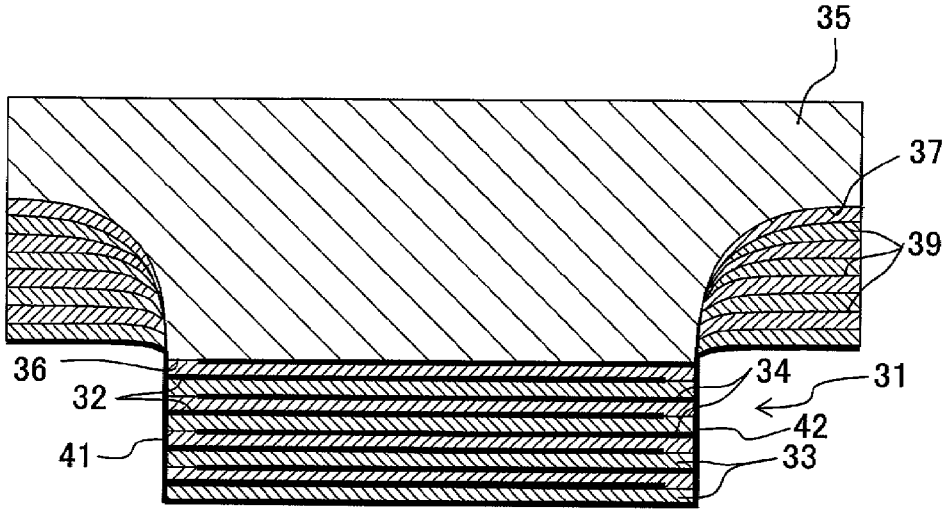
FIG. 14 is a diagram showing a step of forming side surface electrodes.
Figure 15:
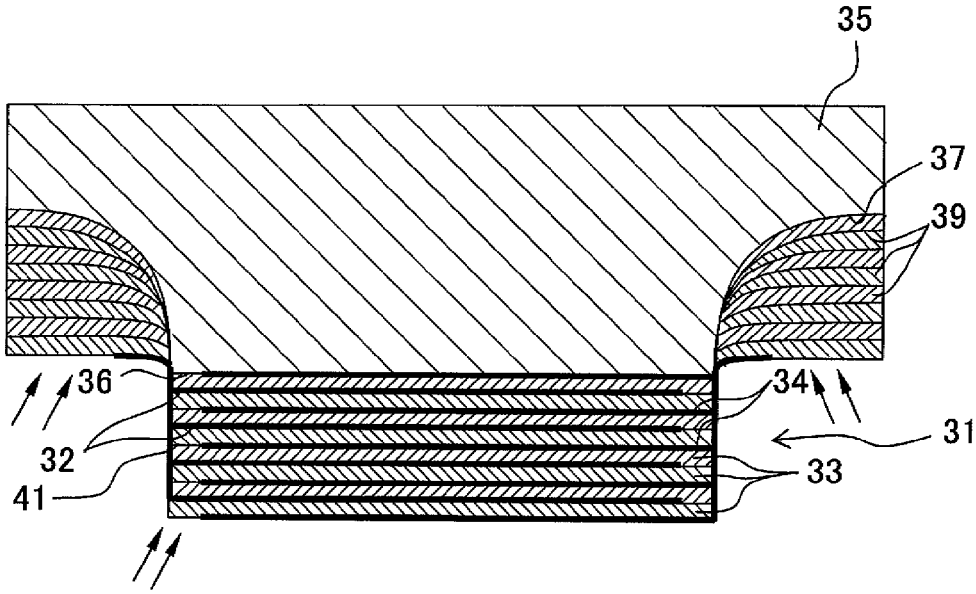
FIG. 15 is a diagram showing a step of removing unnecessary electroconductive film portions.

As shown in FIG. 14, a first side surface electrode 41 and a second side surface electrode 42 are formed on the side surfaces of the piezoelectric element 31 respectively by making the electroconductive films adhere to both side surfaces respectively of each of the piezoelectric element 31 (and to a bottom surface of an outermost layer of the piezoelectric material layers 39 deposited in each of the grooves 37), by a method such as plating. Further, as shown in FIG. 15, conduction between the common electrodes and the individual electrodes is prevented by removing by the laser processing an unnecessary electroconductive film portion in an area between the first side surface electrode 41 and the lowermost layer common electrode 34 in one of the piezoelectric elements 31, and an unnecessary electroconductive film portion in an area between adjacent piezoelectric elements 31. Finally, the plurality of piezoelectric elements 31 and the plurality of supporting columns 40 are joined to the vibration plate 30 by an adhesive (joining step).

According to the method of producing the piezoelectric actuator 3 described above, the following effects are achieved. The particles of the piezoelectric material are less likely to be deposited on the portions of the supporting plate 35 in each of which the groove 37 is formed, as compared to the element-arrangement areas 36 having a plane form. Therefore, it is possible to form the piezoelectric layers 33 in each of the plurality of element-arrangement areas 36 by a simple step of depositing the particles of the piezoelectric material on the supporting plate 35 after forming the grooves 37 around the element-arrangement areas 36 respectively of the supporting plate 35, and it is possible to easily form the plurality of piezoelectric elements 31 which protrude downwardly. Further, as compared to a case of forming the piezoelectric elements 31 by dividing the stacked piezoelectric layers or the piezoelectric layer plate with a dicer or the like, the densely arranged piezoelectric elements 31 can be formed at a low cost.

By forming the piezoelectric layer 33 by making the piezoelectric material to be deposited on the supporting plate 35 by a method such as the aerosol deposition method (AD method), the sputtering method, and the chemical vapor deposition method (CVD method), it is possible to easily form the piezoelectric layer 33 having a desired thickness. Moreover, the piezoelectric element 31 formed by the methods mentioned above has the plurality of piezoelectric layers 33, and it is possible to apply a desired pressure on the ink in the pressure chamber 14 by a voltage lower than a voltage applied in a case of a piezoelectric element having one piezoelectric layer. According to the above-mentioned methods, the stacked type piezoelectric element 31 operable at a low voltage can be formed easily.

Next, modified embodiments in which various modifications are made in the embodiment will be explained. The same reference numerals will be used for components or parts having a structure similar to those in the embodiment, and explanation therefor will be omitted as appropriate.

First Modified Embodiment

Figure 16:
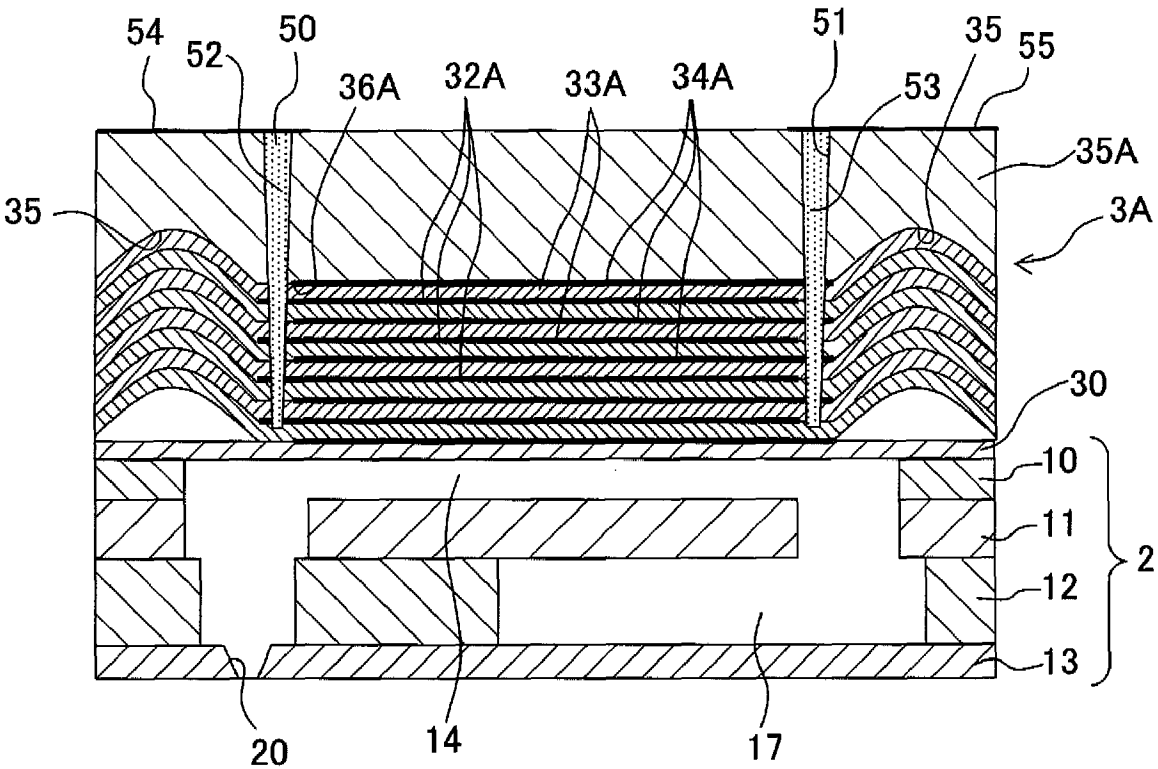
FIG. 16 is a cross-sectional view according to a first modified embodiment, corresponding to FIG. 5.

In the above-described embodiment, the individual electrodes 32 and the common electrodes 34 are drawn toward both side surfaces respectively of the piezoelectric element 31, and are connected to the wiring member such as the FPC via the first side surface electrode 41 and the second side surface electrode 42 formed on the two side surfaces respectively (see FIG. 5). However, in a piezoelectric actuator 3A of the first modified embodiment, when an amount of the deposited piezoelectric material is comparatively great in a groove 35 on a supporting plate 35A around an element-arrangement area 36A as shown in FIG. 16, it can be difficult to form side surface electrodes on side surfaces of a piezoelectric element 31A. In such a case, as shown in FIG. 16, for each piezoelectric element 31A, through holes 50 and 51, penetrating through the supporting plate 35A and piezoelectric layers 33A in a stacking direction of the piezoelectric layers 33A, may be formed, and individual electrodes 32A may be connected with each other via an electroconductive material 52 filled in the through hole 50, and common electrodes 34A may be connected with each other via an electroconductive material 53 filled in the through hole 51.

Among the two through holes 50, 51 formed in each piezoelectric element 31A, the through hole 50 (left side in FIG. 16) is formed in an area in which only the individual electrode 32A overlaps in a plan view. The through hole 50 penetrates through the plurality of piezoelectric layers 33A, and the plurality of individual electrodes 32 are connected mutually via the electroconductive material 52 filled in the through hole 50. Further, the other through hole 51 (right side in FIG. 16) is formed in an area in which only the common electrode 34A overlaps in a plan view. The through hole 51 penetrates through the plurality of piezoelectric layers 33A, and the common electrodes 34A are connected mutually via the electroconductive material 53 filled in the through hole 51. Furthermore, the electroconductive materials 52 and 53 filled inside the through holes 50 and 51 are connected to two terminal portions 54 and 55 respectively, the terminal portions 54 and 55 being formed on the upper surface of the supporting plate 35A. The two terminal portions 54 and 55 are electrically connected to a wiring member such as the FPC.

In the piezoelectric actuator 3A of the first modified embodiment, the electroconductive materials 52 and 53 connected to the individual electrodes 32A and the common electrodes 34A respectively, of each piezoelectric element 31A, are drawn up to the upper surface of the supporting plate 35A. Accordingly, as compared to the embodiment, effects such that connections of the wiring member such as the FPC becomes easy, and the reliability of electric connections are improved, can be achieved.

Second Modified Embodiment

Figure 17:
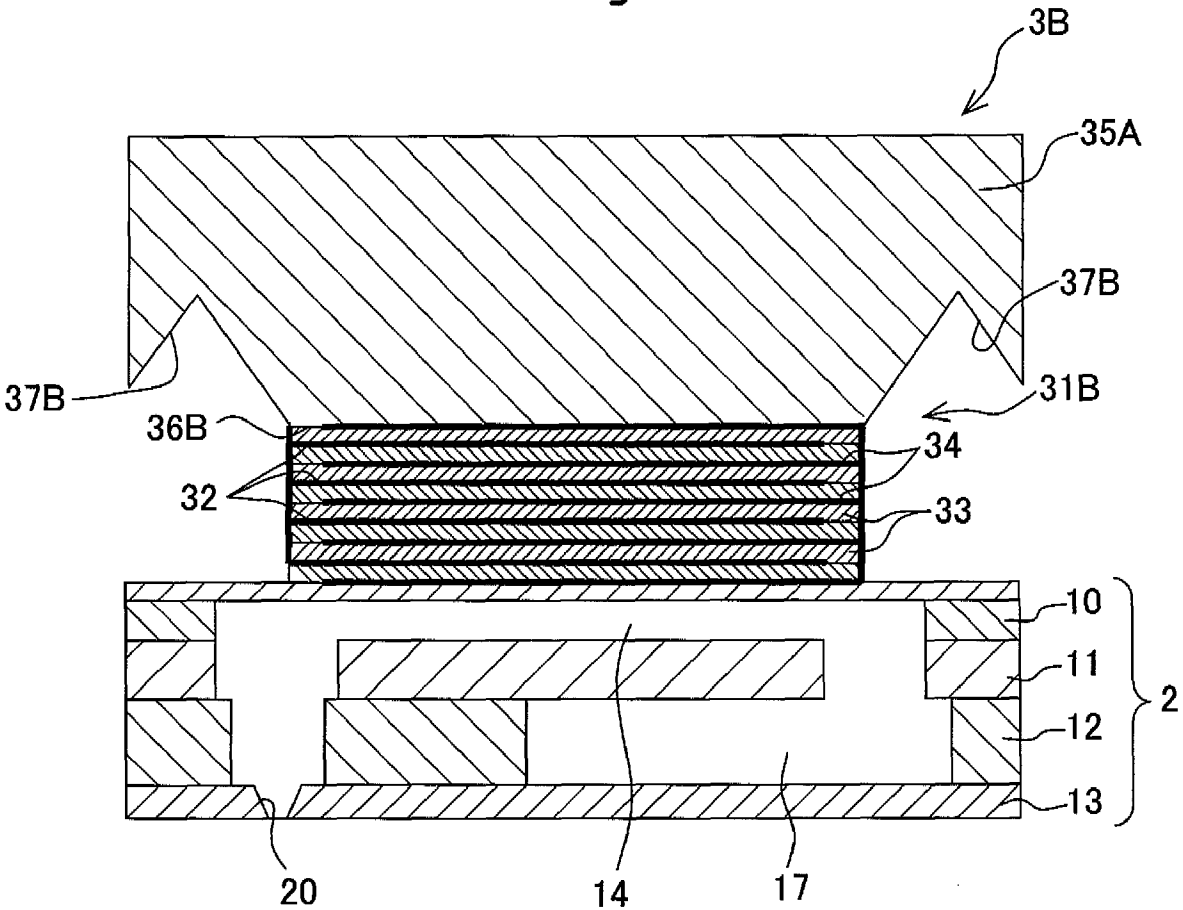
FIG. 17 is a cross-sectional view according to a second modified embodiment, corresponding to FIG. 5.
Figure 18:
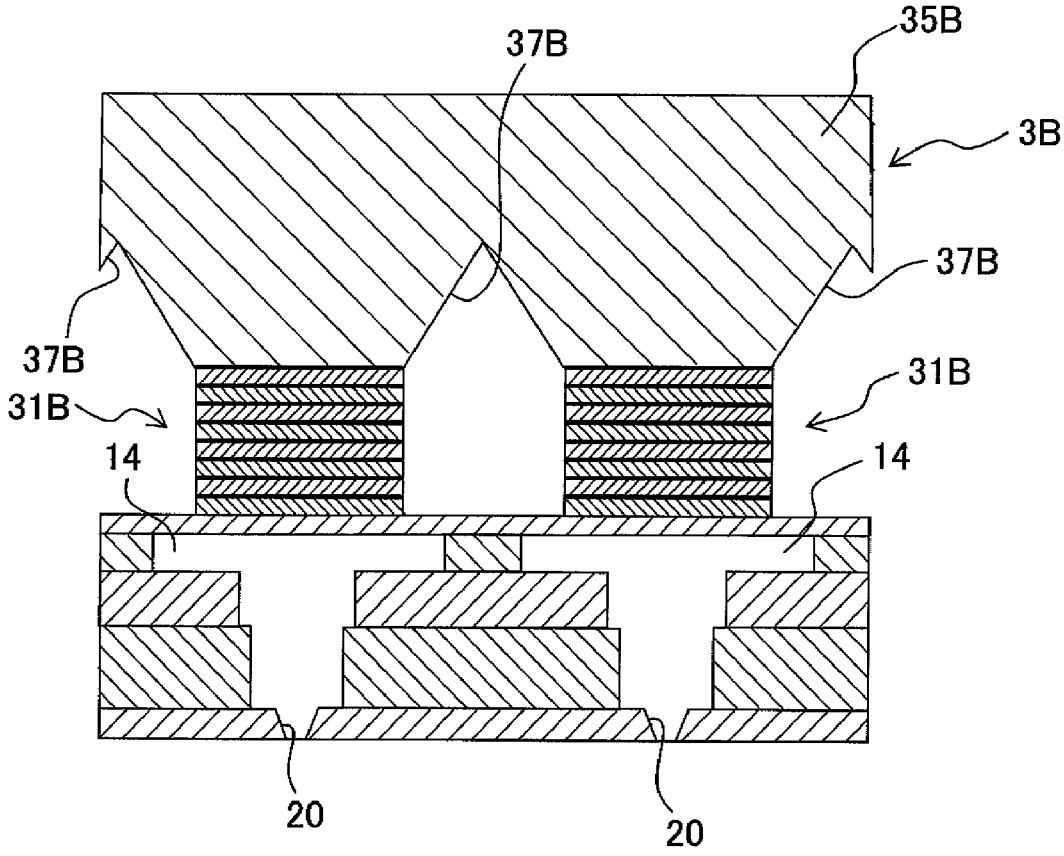
FIG. 18 is a cross-sectional view according to the second modified embodiment, corresponding to FIG. 6.

As shown in FIGS. 17 and 18, in a piezoelectric actuator 3B, an inner surface of a groove 37B of a supporting plate 35B may be formed to be a steep-inclination surface (angle of inclination of not less than 45°, for example), and a shape of an tip end (inner end) of the inner surface may be formed to be sharp. Here, the angle of inclination is defined as an angle formed between a surface parallel to a lower surface of the supporting plate 35B (surface in which element-arrangement area 36B is formed), and a surface forming or defining the groove 37B. By using a method such as an electric discharge processing and an ultrasonic processing, the tip end of the groove 373 can be easily formed to be sharp. Thus, when the inner surface of the groove 37B is formed as a steep-inclined surface, while forming the piezoelectric layer 33, the particles of the piezoelectric material are further less likely to be deposited on the inner surface of the groove 37B. Moreover, since the tip end of the groove 37B is formed to be sharp, the particles of the piezoelectric material are also hardly deposited on the tip end portion. Therefore, since an amount of the piezoelectric material deposited inside the groove 37B is further decreased, while forming a piezoelectric element 31B in the element-arrangement area 36B, the piezoelectric element 31B can be divided and separated assuredly from an adjacent piezoelectric element 31B.

Third Modified Embodiment

Figure 19A:
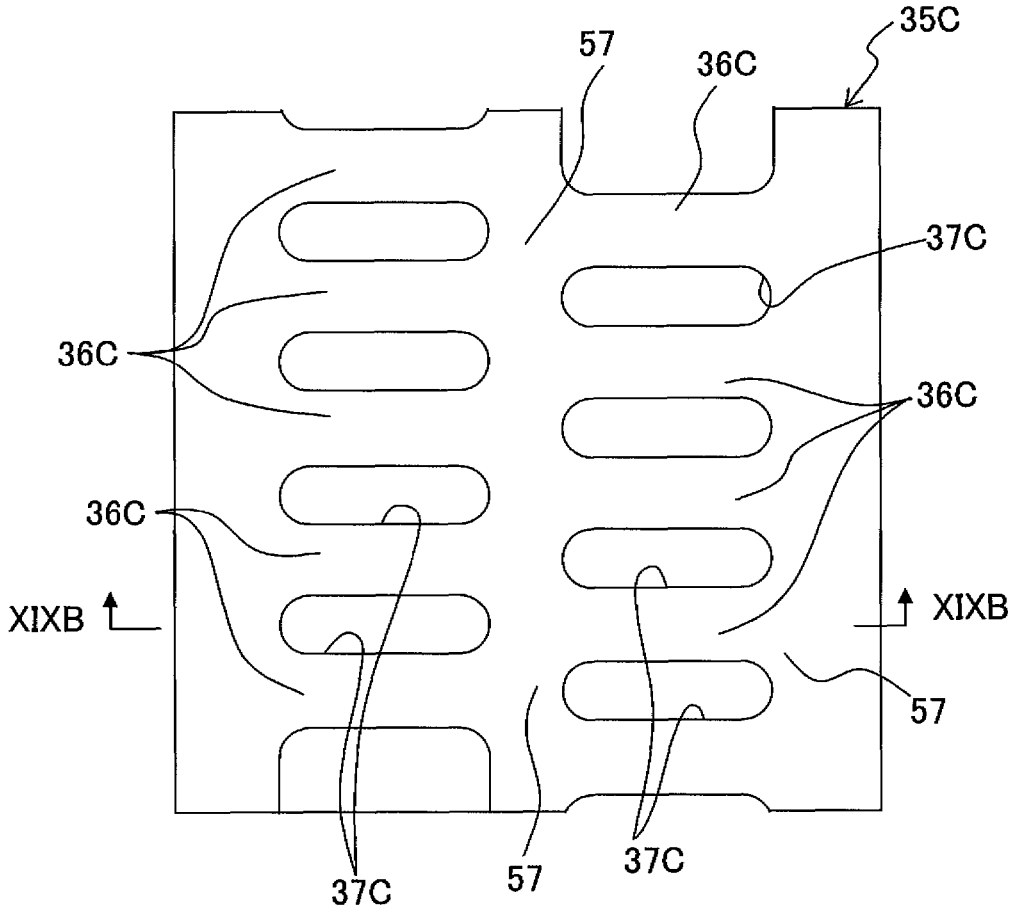
FIG. 19A is a bottom view of the supporting plate.
Figure 19B:
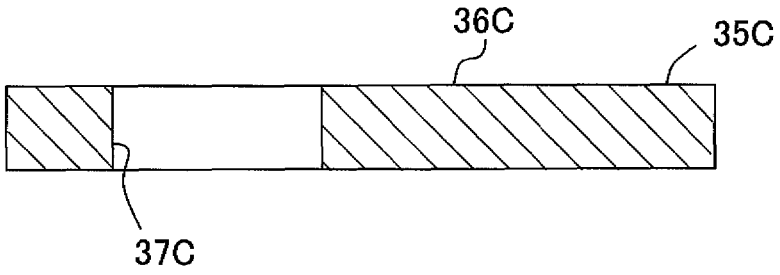
FIG. 19B is a cross-sectional view taken along a line XIX B-XIX B in FIG. 19A.

The particles of the piezoelectric material may be made to be deposited on the supporting plate after forming through holes instead of the groove 37 (see FIGS. 5 and 6) around the element-arrangement area. As shown in FIGS. 19A and 19B, in a supporting plate 35C, a plurality of element-arrangement areas 36A, having a plane form and arranged in two rows in a up and down direction in FIG. 19A, is provided corresponding to the plurality of pressure chambers 14 respectively. A hole 37C, which is substantially elliptical in a plan view, is formed at both sides of each of the element-arrangement areas 36C, the both sides being in a direction in which the element-arrangement areas 36C are arrayed (up and down direction). As shown in FIG. 19A, each element-arrangement area 36C is joined to adjacent element-arrangement areas 36C via connecting portions 57 on both end portions in a longitudinal direction of the element-arrangement area 36C. Further, after forming the common electrodes 34 in each of the element arrangement areas 36C, the particles of the piezoelectric material are allowed to be deposited on an entire surface of the supporting plate 35C by a method such as the AD method, the sputtering method, or the chemical vapor deposition method. At this timer while the particles are not deposited at all on a portion of the supporting plate 35C in which one of the holes 37 is formed, a piezoelectric layer 33C of constant thickness is formed on each of the element-arrangement areas 36C. Afterwards, the individual electrode 32 is formed on the piezoelectric layer 33C in each of the element-arrangement areas 36C.

Figure 20:
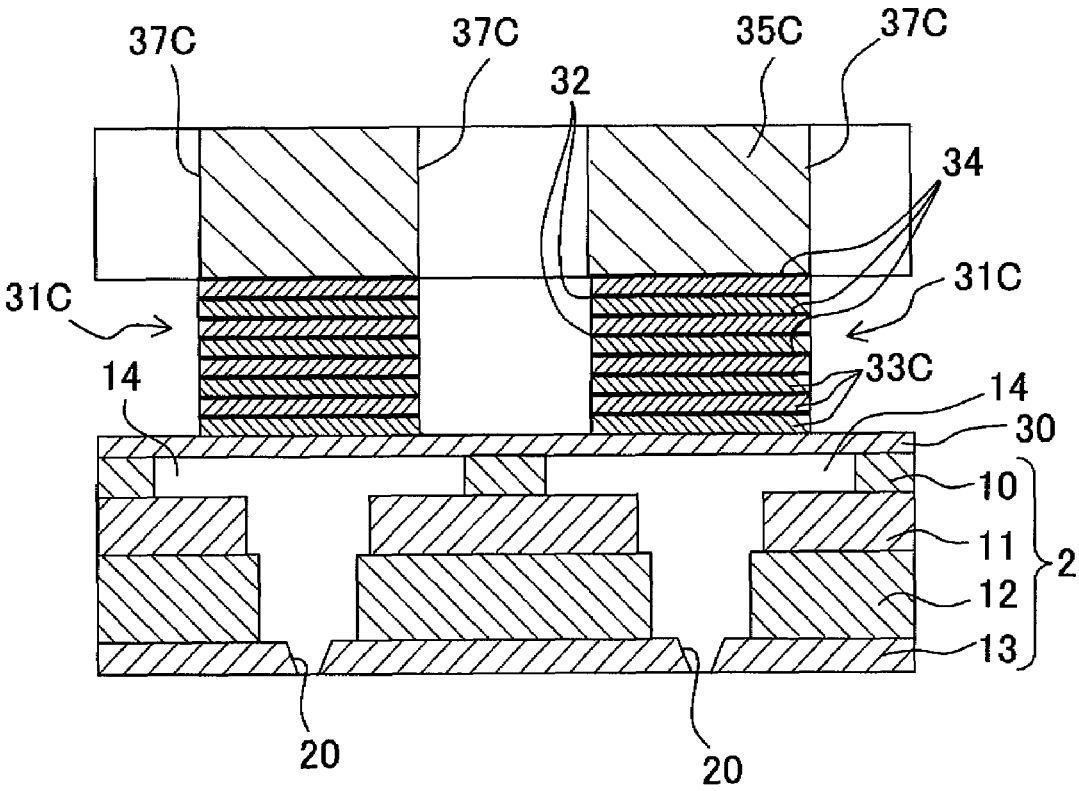
FIG. 20 is a cross-sectional view according to the third modified embodiment, corresponding to FIG. 6.

Further, by alternately repeating the common electrode forming step or the individual electrode forming step, and the piezoelectric layer forming step, a piezoelectric element 31C is formed in each of the element-arrangement areas 36C of the supporting plate 35C. As shown in FIG. 20, each of the piezoelectric elements 31C includes a plurality of piezoelectric layers 33C, and the individual electrodes 32 and the common electrodes 34 arranged alternately between respective layers of the stacked piezoelectric layers 33C, and arranged on upper and lower surfaces of the outermost piezoelectric layers 33C respectively. Afterwards, similarly as in the first modified embodiment, two through holes extending in the stacking direction are formed in the piezoelectric layers 33C of each piezoelectric element 31C, and an electroconductive material is filled in these two through holes. Accordingly, the individual electrodes 32 are conducted with each other by one of the two through holes and the common electrodes 34 are conducted with each other by the other of the two through holes.

Thus, in a case of making the particles of the piezoelectric material to be deposited after forming the holes 37C around the element-arrangement areas 36C of the supporting plate 35C, the piezoelectric material is not deposited on portions corresponding to the through holes 37C at all. There has been hitherto no such a structure in which the holes are formed in the supporting plate as in the third modified embodiment, and it is possible to form, on the element-arrangement areas 36C of the supporting plate 35C, the piezoelectric elements 31C which are perfectly separated by the holes 37C. The shape of the holes 37C is not limited to an elliptical shape as shown in FIG. 19A, and the holes 37C can be formed in various shapes. Here, when the holes 37C are formed to substantially surround the element-arrangement areas 36C, a piezoelectric element 31C formed in a certain element-arrangement area 36C can be isolated or divided assuredly from another piezoelectric element 31C arranged in another element-arrangement area 36C adjacent to this element-arrangement area 36C. At this time, however, a stiffness of the supporting plate 35C is lowered considerably and handling of the supporting plate 35C during the producing process becomes difficult. Therefore, in view of ensuring the stiffness of the supporting plate 35C, it is preferable that the connecting portions 57 which connect the element-arrangement areas 36C have an area to some extent so as to ensure the stiffness the supporting plate 35C. The particles of the piezoelectric material are deposited also on the connecting portions 57 similarly as on the element-arrangement areas 36C, but no electrodes are formed in areas corresponding to the connecting portions 57.

Fourth Modified Embodiment

In the embodiment and each of the modified embodiments, by forming the groove 37 (refer to FIG. 4 and FIG. 5) or the holes 37C (refer to FIGS. 19A and 19B), the areas on which the particles of the piezoelectric material are less likely to be deposited (less-deposition areas), as compared to the element-arrangement areas, are formed. Instead of forming the grooves or the holes, a mask layer which prevents the deposition of the piezoelectric material around the element-arrangement areas may be provided. An example of a producing process when the mask layer is formed will be explained with reference to FIG. 21 (FIGS. 21A to 21E).

Figure 21A:
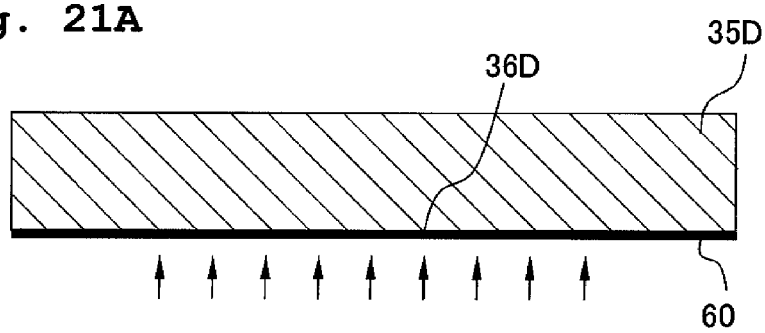
FIG. 21A shows a step of partially exposing a resist coated on the supporting plate.
Figure 21B:
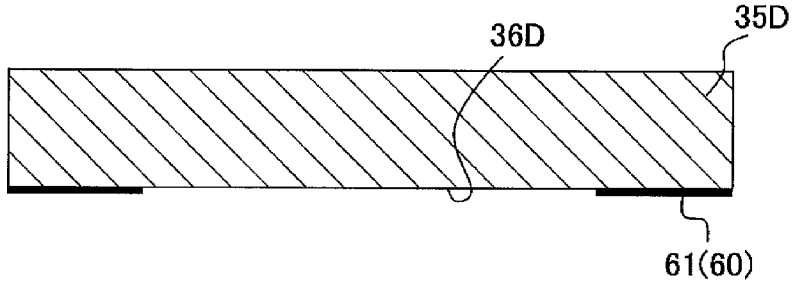
FIG. 21B shows a step of removing the resist which has been exposed.

Firstly, as shown in FIG. 21A, a resist (photoresist) 60 made of a phenol resin or the like is coated by a spin coating method or a dip coating method on one entire surface of a supporting plate 35D, and then the resist 60 in element-arrangement areas 36D, in each of which a piezoelectric element is to be arranged, is exposed. Further, as shown in FIG. 21B, the resist 60 of the exposed portion is washed away by an alkali solution such as TMAH (tetramethyl ammonium hydroxide) developing solution. When the resist 60 is washed away, the resist 60 is remained only around each of the element-arrangement areas 36D, thereby forming a mask layer 61. An area of the supporting plate 35D in which the mask layer 61 is formed corresponds to the less-deposition area of the present application.

Figure 21C:
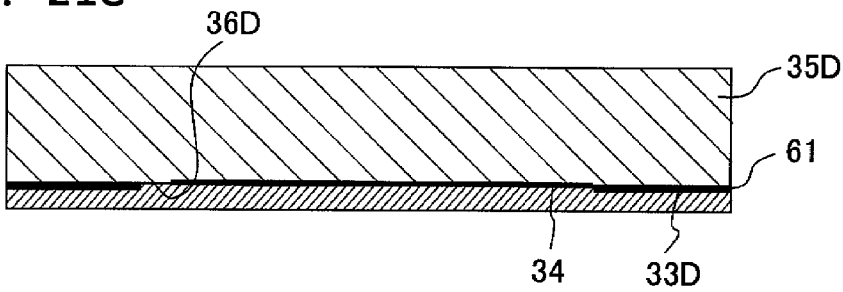
FIG. 21C shows a step of forming a piezoelectric layer.
Figure 21D:
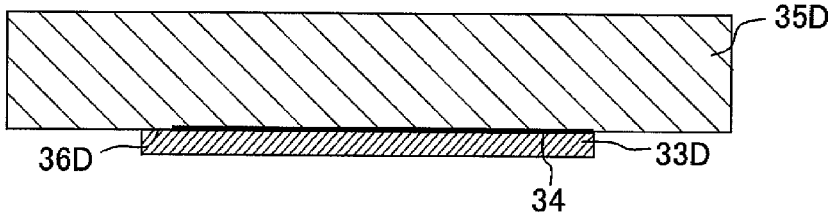
FIG. 21D shows a step of stripping the remained resist off.
Figure 21E:
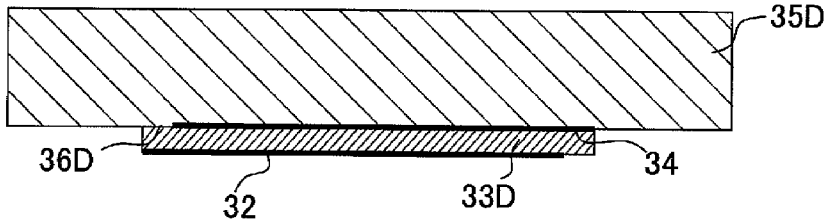
FIG. 21E shows a step of forming an individual electrode.

Next, as shown in FIG. 21C, a common electrode 34 is formed in each of the element-arrangement areas 36D from which the resist 60 has been removed, and then a piezoelectric layer 33D is formed by making the particles of the piezoelectric material to be deposited on an entire surface of the supporting plate 35D, by a method such as the AD method, the sputtering method or the CVD method. Further, as shown in FIG. 21D, by using a resist stripping solution (resist peeling solution) such as alkylbenzene sulfonic acid, the mask layer 61 and the piezoelectric layer 33D deposited on the surface of the mask layer 61 are removed. Accordingly, the piezoelectric layer 33D is remained and formed only in each of the element-arrangement areas 36D. Further, an individual electrode 32 is formed on the piezoelectric layer 33D.

Subsequently, by repeating alternately the step of forming the common electrode 34 or the individual electrode 32 and the step of forming the piezoelectric layer 33D, piezoelectric elements each including a plurality of piezoelectric layers 33D, a plurality of individual electrodes 32, and a plurality of common electrodes 34 are formed on the supporting plate 35D in the element-arrangement areas 36D respectively. In this case also, similarly as in the embodiment, the plurality of piezoelectric elements arranged densely can be formed at a low cost as compared to a case in which a piezoelectric layer plate or stacked piezoelectric layers are divided to form the piezoelectric elements with the dicer or the like. In the fourth modified embodiment, the mask layer 61, formed in the beginning of the process on the surface of the supporting plate 35D, may be removed after forming the plurality of common electrodes 34, the plurality of individual electrodes 32, and the plurality of piezoelectric layers 33D.

Fifth Modified Embodiment

Figure 22:
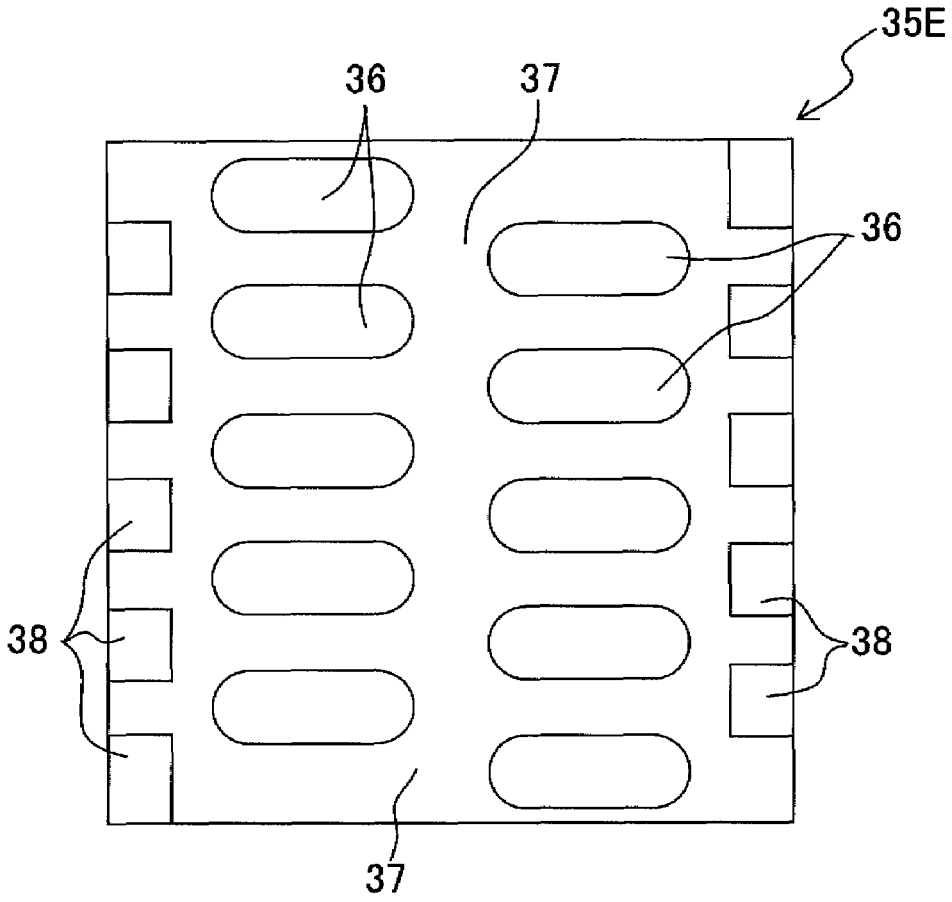
FIG. 22 is a plan view according to a fifth modified embodiment, corresponding to FIG. 7.
Figure 23A:
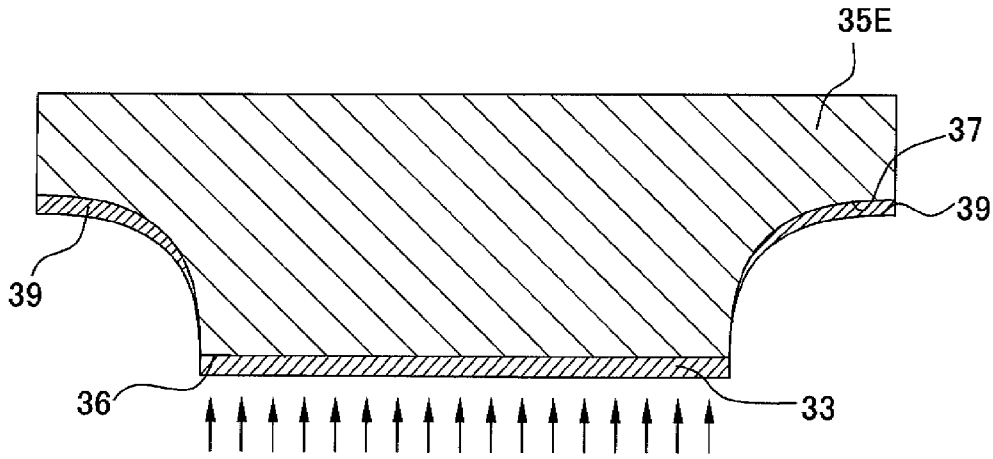
FIG. 23A shows a step of forming a piezoelectric layer.
Figure 23B:
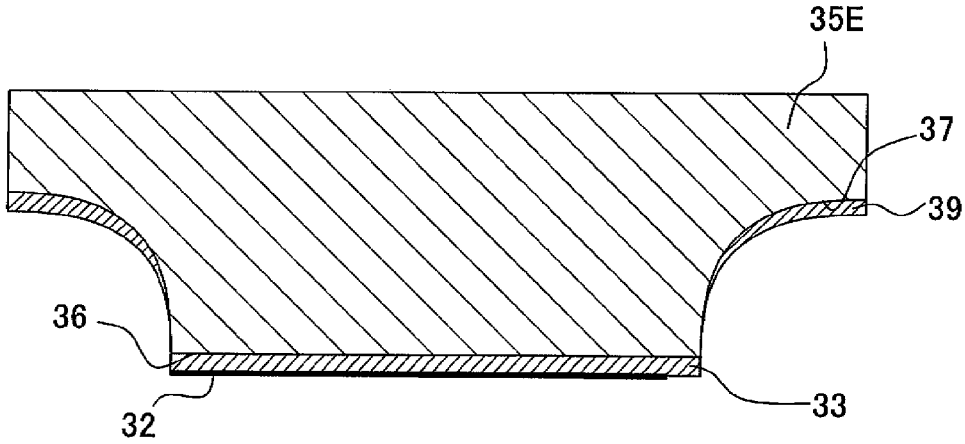
FIG. 23B shows a step of forming an individual electrode.

The embodiment and its modified embodiments are examples in which the present invention is applied for producing a piezoelectric actuator which includes the plurality of piezoelectric elements each having stacked piezoelectric layers. However, the present invention can also be applied to produce a piezoelectric actuator which includes a plurality of piezoelectric elements each having a single piezoelectric layer. A method for producing the piezoelectric actuator which includes piezoelectric elements each having a single piezoelectric layer will be explained below. Firstly, grooves 37 having a shape same as in the embodiment are formed by half etching in a lower surface of a supporting plate 35E made of stainless steel. By forming the grooves 37 in the lower surface of the supporting plate 35E in this manner, element-arrangement areas 36 and areas 38 are formed. FIG. 22 shows a schematic plan view of the supporting plate 35E formed in this manner as viewed from a side of the lower surface. Next, similarly as in the embodiment, a piezoelectric layer 33 is formed by the AD method in each of the element-arrangement areas 36 (FIG. 23A). At this time, although not shown in the diagram, a layer of the piezoelectric material (supporting column 40) of substantially the same thickness as the element-arrangement area 36 is formed in each of the areas 38. Further, in the grooves 37, particles of the piezoelectric material are deposited only in an amount which is not substantial. Next, similarly as in the embodiment, the individual electrode 32 is provided by the screen printing, and a piezoelectric element 31E is formed (FIG. 23B) in each of the element-arrangement areas 36. Further, the piezoelectric element 31E in each of the element-arrangement areas 36 and the supporting columns 40 are joined, with an adhesive, to a vibration plate 30 formed of an insulating material.

As the supporting plate 35E made of a metallic material functions as the common electrode, the step of forming the common electrode can be omitted. Further, since the supporting plate 35E is a metallic material, the grooves 37 can be formed easily by using a method such as half etching. Furthermore, since the vibration plate 30E is formed of an insulating material, there is no fear that an individual electrode 32 of a certain piezoelectric element 31E is short-circuited with an individual electrode 32 of a different piezoelectric element 31E via the vibration plate 30E.

The supporting plate 35E may be formed of an insulating material. In this case, before forming the piezoelectric layer on the supporting plate 35E, the electrode is formed in each of the element-arrangement areas 36 similarly as in the embodiment. At this time, when a vibration plate is formed of an electroconductive material, the electrodes formed on the supporting plate 35E may be made to function as the individual electrodes, and the vibration plate may be made to function as the common electrode. Further, a cross-sectional shape of the groove 37 formed in the supporting plate 35E may be arbitrary. Alternatively, the less-deposition areas may be provided by forming through holes or a mask layer, instead of forming the grooves 37.

In the embodiment and in the modified embodiments, when the supporting plate or the vibration plate is formed of an electroconductive material, and there is a fear that the individual electrodes come into contact with the supporting plate or the vibration plate, an insulating film may be provided at least at areas of the supporting plate or the vibration plate, in each of which the supporting plate or the vibration plate comes into contact with one of the individual electrodes.

The embodiment and its modified embodiments in which the present invention is applied to an ink-jet head have been explained. However, an embodiment to which the present invention is applicable is not limited to the embodiment and the modified embodiments described above. For example, the present invention can also be applied to a piezoelectric actuator for a liquid transporting apparatus which transports liquids other than ink.

What is claimed is:

1. A method of producing a piezoelectric actuator for a liquid transporting apparatus, which is provided on one surface of a channel unit in which a liquid channel including a plurality of pressure chambers is formed, and which includes a vibration plate covering the pressure chambers; a plurality of piezoelectric elements arranged, in the vibration plate on a side opposite to the pressure chambers, to correspond to the pressure chambers respectively; and a supporting section which supports these piezoelectric elements from a side opposite to the vibration plate, the method comprising:

a step of providing a supporting plate which forms the supporting section, and which has, on one surface thereof, element-arrangement areas in which the piezoelectric elements are to be arranged respectively;

a less-deposition area forming step of forming, on the supporting plate, less-deposition areas around the element-arrangement areas respectively;

a piezoelectric element forming step of forming the piezoelectric elements by depositing particles of the piezoelectric material more on the element-arrangement areas of the supporting plate than on the less-deposition areas, and a joining step of joining the piezoelectric elements to the vibration plate, such that the piezoelectric elements are arranged between the supporting plate and the vibration plate, wherein the less-deposition areas are configured such that an amount of the piezoelectric particles, per unit area, deposited directly onto the less-deposition areas is less than an amount of the piezoelectric particles, per unit area, deposited onto the element-arrangement areas.

2. The method of producing the piezoelectric actuator according to claim 1, wherein in the less-deposition area forming step, grooves or holes are formed in the supporting plate around the element-arrangement areas respectively.

3. The method of producing the piezoelectric actuator according to claim 1, wherein in the piezoelectric element forming step, the piezoelectric material is deposited on the supporting plate by an aerosol deposition method, a sputtering method, or a chemical deposition method.

4. The method of producing the piezoelectric actuator according to claim 1, wherein in the piezoelectric element forming step, each of the piezoelectric elements is formed on the supporting plate by alternately repeating steps of: forming a first electrode which is to be applied with a predetermined voltage, forming one piezoelectric layer by depositing the particles of the piezoelectric material, and forming a second electrode which is to be maintained at a common reference potential, such that each of the piezoelectric elements are stacked and include the one piezoelectric layer, between the first electrode and the second electrode.

5. The method of producing the piezoelectric actuator according to claim 1, wherein the piezoelectric element forming step includes a step of forming one piezoelectric layer by depositing the particles of the piezoelectric material on the supporting plate, and a step of forming a first electrode to which a predetermined drive voltage is to be applied; and the piezoelectric elements each including the one piezoelectric layer and the first electrode being formed on the supporting plate.

6. The method of producing the piezoelectric actuator according to claim 1, wherein in the piezoelectric element forming step, a thickness of the piezoelectric elements, each of which is formed on the element-arrangement areas, is greater than a thickness of the piezoelectric material formed on the less-deposition areas, respectively.

* * * * *